US011633832B2

(12) United States Patent
Aubin et al.

(10) Patent No.: US 11,633,832 B2
(45) Date of Patent: Apr. 25, 2023

(54) SYSTEMS AND METHODS FOR SANDING A SURFACE OF A STRUCTURE

(71) Applicants: The Boeing Company, Chicago, IL (US); University of Washington, Seattle, WA (US)

(72) Inventors: John R. Aubin, Seattle, WA (US); Lance O. McCann, Seattle, WA (US); Alexander H. de Marne, Mountlake Terrace, WA (US); Terrence J. Rowe, Seattle, WA (US); Gary Davis, Mukilteo, WA (US); Cameron Devine, Bellevue, WA (US); Tony Piaskowy, Seattle, WA (US); Kenneth W. Latimer, III, Seattle, WA (US)

(73) Assignees: The Boeing Company, Arlington, VA (US); University of Washington, Seattle, WA (US)

( * ) Notice: Subject to any disclaimer, the term of this patent is extended or adjusted under 35 U.S.C. 154(b) by 1182 days.

(21) Appl. No.: 16/205,947

(22) Filed: Nov. 30, 2018

(65) Prior Publication Data

US 2020/0171620 A1 Jun. 4, 2020

(51) Int. Cl.

| | |
|---|---|
| ***B24B 51/00*** | (2006.01) |
| ***B24B 7/10*** | (2006.01) |
| ***B24B 49/12*** | (2006.01) |

(52) U.S. Cl.

CPC ..... *B24B 51/00* (2013.01); *B24B 7/10* (2013.01); *B24B 49/12* (2013.01)

(58) Field of Classification Search

CPC ... B24B 19/26; B24B 27/0038; B24B 49/006; B24B 49/10; B24B 49/16; B26J 13/085; B26J 11/0065

See application file for complete search history.

(56) References Cited

U.S. PATENT DOCUMENTS 5,299,389 A * 4/1994 Yonaha ..... B25J 9/1684 451/5
6,380,512 B1 * 4/2002 Emer ..... F01D 5/005 219/121.85

(Continued)

FOREIGN PATENT DOCUMENTS

DE 0444657 A1 * 9/1991 ..... B23Q 17/0966
WO WO-03058360 A1 * 7/2003 ..... G05B 19/4099

OTHER PUBLICATIONS

Temple Allen Institutes: "Easily Manipulated Mechanical Arm (EMMA)," https://www.templeallen.com/Current-Brochures-Printing/TAI_Ground_Systems_8.5x11.pdf.

(Continued)

*Primary Examiner* — Joel D Crandall

(74) *Attorney, Agent, or Firm* — Walters & Wasylyna LLC

(57) ABSTRACT

A system for sanding a surface includes a sanding tool, a robotic manipulator to move the sanding tool relative to the surface, and a control unit operatively coupled with the sanding tool and the robotic manipulator. The control unit is operable to: (1) move the sanding tool to a sanding position relative to the surface in which an abrasive surface is in contact with the surface and a sanding force is approximately normal to the surface; (2) set one or more sanding parameters corresponding to a model material removal rate; (3) monitor one or more of the sanding parameters; (4) determine an actual material removal rate, based on one or more of the sanding parameters being monitored; and (5) modify one or more of the sanding parameters until the actual material removal rate is approximately equal to the model material removal rate.

20 Claims, 11 Drawing Sheets

(56) References Cited

U.S. PATENT DOCUMENTS

| | | | | |
|---|---|---|---|---|
| 7,118,452 | B2 | 10/2006 | Wood | |
| 7,252,577 | B2 | 8/2007 | Wood | |
| 9,272,382 | B2 | 3/2016 | Trnka | |
| 9,505,101 | B1 | 11/2016 | Register | |
| 9,839,986 | B2 | 12/2017 | Best et al. | |
| 10,035,237 | B2 | 7/2018 | Panergo et al. | |
| 2002/0072297 | A1 | 6/2002 | Kennerknecht et al. | |
| 2006/0048364 | A1* | 3/2006 | Zhang | B23Q 17/0966 29/709 |
| 2009/0220349 | A1* | 9/2009 | Bolms | F01D 5/005 451/6 |
| 2014/0127975 | A1 | 5/2014 | Roy et al. | |
| 2014/0154470 | A1* | 6/2014 | Teo | G05B 19/4099 428/156 |
| 2018/0154495 | A1* | 6/2018 | Mullany | B24D 13/145 |

OTHER PUBLICATIONS

Composites World blog post: "Mechanized arm speeds sanding of large composites while reducing injuries," https://www.compositesworld.com/blog/post/mechanized-arm-speeds-sanding-of-large-composites-while-reducing-injuries(2) (Nov. 11, 2013).

R. Poiree et al.: "Material Removal Distribution in Robotized Random Orbital Sanding," Research in Interactive Design—vol. 4, pp. 558-564 (2016).

G. Zhang et al.: "3D Curvature Grinding Path Planning Based on Point Cloud Data," Shanghai Key Laboratory of Materials Laser Processing and Modification, School of Materials Science and Engineering, Shanghai Jiao Tong University, Shanghai, China, and Department of Mechanical Engineering, University of Canterbury, Christchurch, New Zealand (2016).

F. W. Preston: "The Theory and Design of Plate Glass Polishing Machines," Journal of the Society of Glass Technology, pp. 214-256 (1927).

M.J. Tsai et al.: "Robotic polishing of precision molds with uniform material removal control," International Journal of Machine Tools & Manufacture, Elsevier, vol. 49, pp. 885-895 (2009).

F. Tian et al.: "Modeling and control of robotic automatic polishing for curved surfaces," CIRP Journal of Manufacturing Science and Technology, Elsevier, vol. 14, pp. 55-64 (2016).

* cited by examiner

SYSTEMS AND METHODS FOR SANDING A SURFACE OF A STRUCTURE

FIELD

The present disclosure is generally related to systems and methods for sanding a surface and, more particularly, to systems and methods for sanding a surface using a consistent material removal rate and for enabling human-machine collaboration during sanding.

BACKGROUND

Article manufacturing typically includes various machining operations and finishing operations performed on a component of the article or on the article itself. One such finishing operation is sanding of a surface with an abrasive material to smooth or polish the surface to a desired degree or to activate the surface for subsequent assembly or coating or other processes. In many circumstances, the entire surface may not require the same amount of sanding and/or different structures may have different surface geometries. In some instances, the sanding operation is performed manually, such as by an operator using a hand sander. Manual sanding enables sanding to be performed on surfaces having different geometries and enables different locations on the surface to be sanded to different degrees. However, manual sanding may be a cause of a repetitive motion injury to the operator. In other instances, the sanding operation is performed automatically, such as by an automated robotic sander. Automated sanding eliminates operator interaction and decreases processing time. However, automated sanding is not readily capable of identifying to what degree of sanding is needed at particular locations on the surface. Further, automated sanding requires numerical control programming for each one of the different surface geometries to be sanded. Further, neither manual nor automated sanding readily facilitates sanding with a consistent material removal rate.

Accordingly, those skilled in the art continue with research and development efforts in the field of sanding operations and, as such, systems and methods, intended to address the above-identified concerns, would find utility.

SUMMARY

The following is a non-exhaustive list of examples, which may or may not be claimed, of the subject matter according to the present disclosure.

In an example, a disclosed system for sanding a surface of a structure includes a sanding tool including an abrasive surface. The system further includes a robotic manipulator coupled to the sanding tool and configured to move the sanding tool relative to the structure. The system also includes a control unit operatively coupled with the sanding tool and the robotic manipulator. The control unit is operable to: (1) move the sanding tool to a sanding position relative to the surface of the structure in which the abrasive surface is in contact with the surface and a sanding force is approximately normal to the surface; (2) set one or more sanding parameters corresponding to a model material removal rate; (3) monitor one or more of the sanding parameters when the sanding tool is in the sanding position; (4) determine an actual material removal rate, based on one or more of the sanding parameters being monitored; and (5) modify one or more of the sanding parameters until the actual material removal rate is approximately equal to the model material removal rate.

In an example, a disclosed method for sanding a surface of a structure includes steps of: (1) moving a sanding tool to a sanding position relative to the surface of the structure in which an abrasive surface of the sanding tool is in contact with the surface and a sanding force is approximately normal to the surface; (2) setting one or more sanding parameters corresponding to a model material removal rate; (3) monitoring one or more of the sanding parameters when the sanding tool is in the sanding position; (4) determining an actual material removal rate, based on one or more of the sanding parameters being monitored; and (5) modifying one or more of the sanding parameters (126) until the actual material removal rate is approximately equal to the model material removal rate.

Other examples of the disclosed system and method will become apparent from the following detailed description, the accompanying drawings and the appended claims.

DETAILED DESCRIPTION

Figure 1:
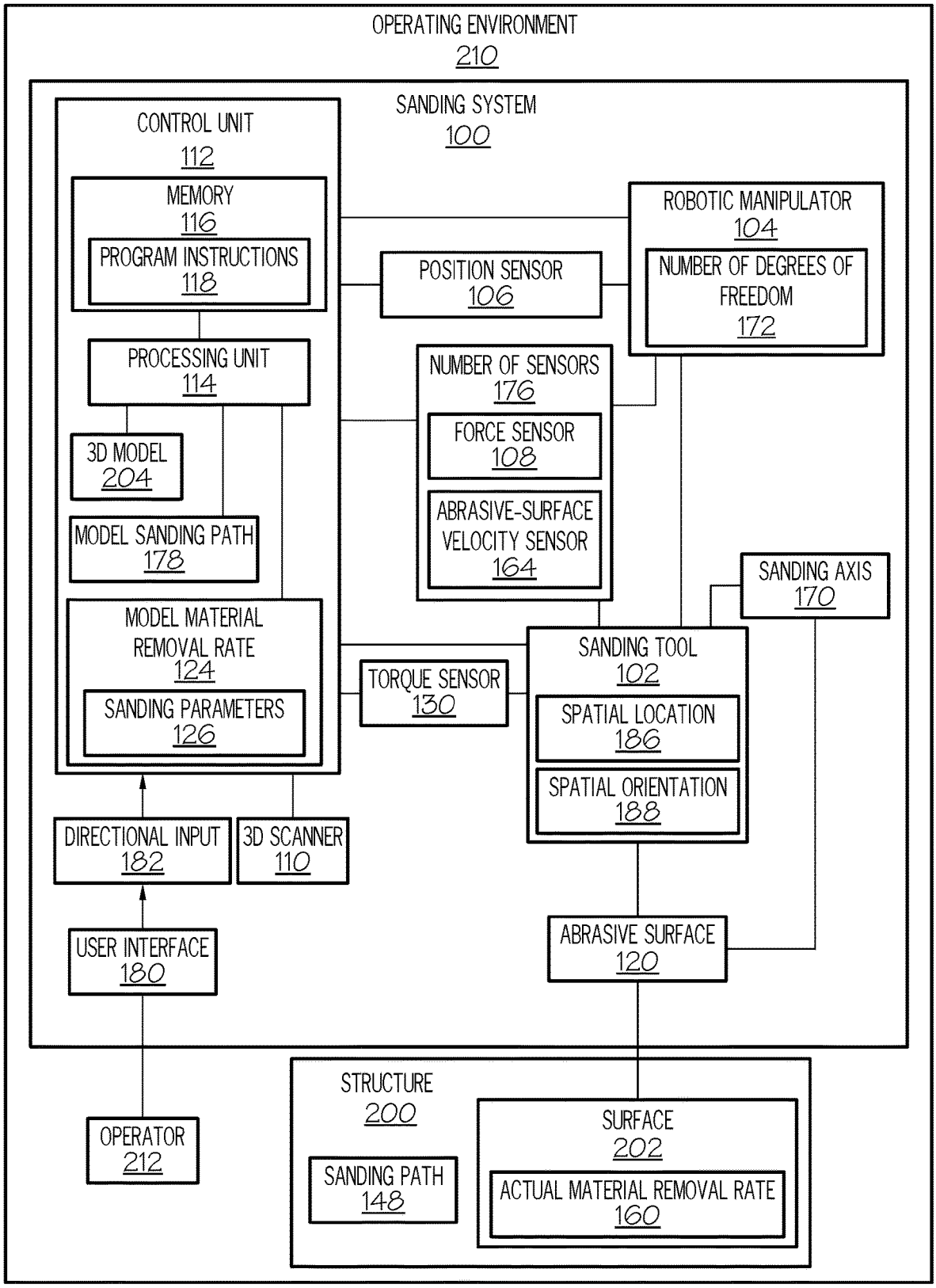
FIG. 1 is a schematic block diagram of an example of an operating environment for a system for sanding a surface of a structure.

The following detailed description refers to the accompanying drawings, which illustrate specific examples described by the disclosure. Other examples having different structures and operations do not depart from the scope of the present disclosure. Like reference numerals may refer to the same feature, element, or component in the different drawings.

Illustrative, non-exhaustive examples, which may be, but are not necessarily, claimed, of the subject matter according the present disclosure are provided below. Reference herein to "example" means that one or more feature, structure, element, component, characteristic and/or operational step described in connection with the example is included in at least one embodiment and/or implementation of the subject matter according to the present disclosure. Thus, the phrases "an example," "one or more examples," and similar language throughout the present disclosure may, but do not necessarily, refer to the same example. Further, the subject matter characterizing any one example may, but does not necessarily, include the subject matter characterizing any other example.

Referring to FIGS. 1-10, the present disclosure provides examples of a system 100 for sanding a surface 202 of a structure 200. Throughout the present disclosure, an operation or process of sanding the surface 202 of the structure 200 may be referred to generally as a "sanding operation." For the purpose of the present disclosure, the terms or phrases "sanding," "to sand," and similar terms or phrases have their ordinary meaning as known to those skilled in the art and refer to smoothing or polishing a surface with an abrasive material so that, for example, the surface is free from projections, is free from unevenness, has a uniform surface consistency, and/or has a desired surface roughness or surface texture.

The present disclosure recognizes that automated sanding, such as by a programmable automated robot and power sander, has certain inherent shortcomings and disadvantages. As an example, automatic sanding systems are not readily capable of identifying how much sanding is required at a particular location on a surface to achieve a desired surface characteristic, which may require manual sanding to finish the sanding operation and achieve the desired surface characteristic. As another example, automatic sanding systems require a rigid mounting fixture and discrete computer numerical control to be programmed for different structures having different surface geometries, which increases the processing time and costs associated with automated sanding. As another example, automatic sanding systems require an accurate three-dimensional model of the surface to be sanded; however, the designed surface represented by the model may differ from the surface as built.

The present disclosure also recognizes that manual sanding, such as by a human operator using a hand sander, has certain inherent shortcomings and disadvantages. As an example, manual sanding requires human labor, which is typically slower than automated sanding. As another example, manual sanding requires the operator to physically manipulate the sander, which may place the operator at risk of repetitive motion or other injuries.

One or more examples of the disclosed system 100 enable human-machine collaboration during the sanding operation. Human-machine collaboration may mitigate or eliminate many of the shortcomings or disadvantages of fully automated sanding operations and manual sanding operations.

The present disclosure further recognizes that neither automated sanding nor manual sanding is readily capable of sanding a surface at a consistent material removal rate, particularly when the surface has a variable surface geometry or is made of different materials. Automated sanding systems may apply a constant force, corresponding to a constant sanding pressure, on the surface, which may result in a variable, or inconsistent, material removal rate when the sander moves over the surface. Human operators using a hand sander may apply erratic forces on the surface, which may result in a variable, or inconsistent, material removal rate when the sander moves over the surface. Inconsistent material removal rates may result in inconsistent results or inaccuracies in surface characteristics.

One or more examples of the disclosed system 100 also enable the sanding operation to be performed utilizing a consistent material removal rate. Utilization of a consistent material removal rate may improve the quality and accuracy of the sanding operation. In particular, utilizing a consistent material removal rate may achieve a consistent material removal depth, for example, when the sander moves across the surface or at different locations on the surface. Additionally, utilizing a consistent material removal rate may achieve consistent surface characteristics, particularly when the surface has a variable surface geometry or is made of different materials.

For the purpose of the present disclosure, the terms "consistent," "consistently," and similar terms, such as in reference to a condition being consistent or consistently maintaining a condition, refers to a condition of an activity, action, or operation that is unchanging in nature, character, or effect over time or an activity, action, or operation that is performed the same way or that has the same effect over time, for example, within an acceptable tolerance or accuracy. In an example, the terms "consistently," "consistent," and similar terms may refer to a condition that is subject to change, but that is selectively controlled to prevent or mitigate such a change. In an example, the terms "consistently," "consistent," and similar terms may refer to a condition that is continuous or constant.

Referring generally to FIG. 1 and particularly to FIGS. 2-5, in an example, the system 100 includes a sanding tool 102. The sanding tool 102 includes an abrasive surface 120. The sanding tool 102 has a sanding axis 170 (FIGS. 1 and 2) that is perpendicular to the abrasive surface 120. The system 100 also includes a robotic manipulator 104. The robotic manipulator 104 is coupled to the sanding tool 102. The robotic manipulator 104 is configured to move the sanding tool 102 relative to the structure 200.

The system 100 also includes a control unit 112. The control unit 112 is operatively coupled with the sanding tool 102 and with the robotic manipulator 104. The control unit 112 is configured to move the sanding tool 102 to a sanding position relative to the surface 202 of the structure 200. When the sanding tool 102 is in the sanding position, the abrasive surface 120 is in contact with the surface 202. When the sanding tool 102 is in the sanding position, the sanding axis 170 of the sanding tool 102 and a sanding force 128 (FIG. 5), applied to the surface 202 of the structure 200 by the sanding tool (102), is approximately normal to the surface 202.

The control unit 112 is also configured to set one or more sanding parameters 126 (FIG. 1) corresponding to a model material removal rate 124 (FIG. 1). The control unit 112 is further configured to monitor one or more of the sanding parameters 126, while the sanding tool 102 is in the sanding position. The control unit 112 is additionally configured to determine an actual material removal rate 160 (FIG. 1), based on one or more of the sanding parameters 126 being monitored. The control unit 112 is also configured to modify one or more of the sanding parameters 126, while the sanding tool 102 in the sanding position, so that the actual material removal rate 160 is approximately equal to the model material removal rate 124.

The system 100 enables the actual material removal rate 160, which is achieved during the sanding operation, to be set and/or consistently maintained approximately equal to the model material removal rate 124 via automatically and regularly monitoring and adjusting one or more of the sanding parameters 126, while the sanding tool 102 is in the sanding position. Achieving and consistently maintaining the model material removal rate 124 during the sanding operation provides for a consistent material-removal depth and/or consistent surface characteristics to be achieved via a fully autonomous or semi-autonomous sanding operation.

For the purpose of the present disclosure, the phrase "actual material removal rate" refers to an actual or realized rate of material removal achieved during the sanding operation. In an example, the actual material removal rate 160 is measured, determined, computed, or otherwise ascertained from data corresponding to and generated from monitoring one or more of the sanding parameters 126.

For the purpose of the present disclosure, the phrase "model material removal rate" refers to a pre-selected, pre-designated, or pre-calculated rate of material removal that is desired for the sanding operation performed on the structure 200. In an example, the model material removal rate 124 is selected or calculated to achieve one or more particular surface characteristics of the surface 202, such as evenness, consistency, roughness, and/or texture, and/or is based on one or more characteristics of the structure 200, such as the material forming the structure 200 or the surface 202.

In an example, the rate of material removal is defined in terms of a volume of material removed per a unit time. In another example, the rate of material removal is defined in terms of depth of material removed. In such examples, the rate of material removal may be constant across the entire surface of the structure or may vary across the surface. For example, the desired depth of material removed or the desired volume of material removed may be greater at one location on the surface and less at another location on the surface.

For the purpose of the present disclosure, the term "approximately" and similar terms and phrases, such as in reference to the actual material removal rate being approximately equal to the model material removal rate, refers to or represents a condition that is close to, but not exactly, the stated condition that still performs the desired function or achieves the desired result. In an example, the term "approximately" refers to a condition that is within an acceptable predetermined tolerance or accuracy. In an example, the term "approximately" refers to a condition that is within 10% of the stated condition. However, the term "approximately" does not exclude a condition that is exactly the stated condition. Accordingly, the term "approximately equal" may be interpreted to mean equal to or within a desired degree of accuracy.

Generally, the control unit 112 actively works to minimize the error between the actual material removal rate 160 achieved during the sanding operation and the model material removal rate 124. For example, the control unit 112 actively processes (e.g., evaluates, analyzes, and/or compares) the sanding parameters 126 being monitored to minimize the error between one or more actual sanding parameters (e.g., the monitored sanding parameters) corresponding to, or used to determine, the actual material removal rate 160 and one or more model sanding parameters corresponding to, or used to generate, the model material removal rate 124.

Figure 2:
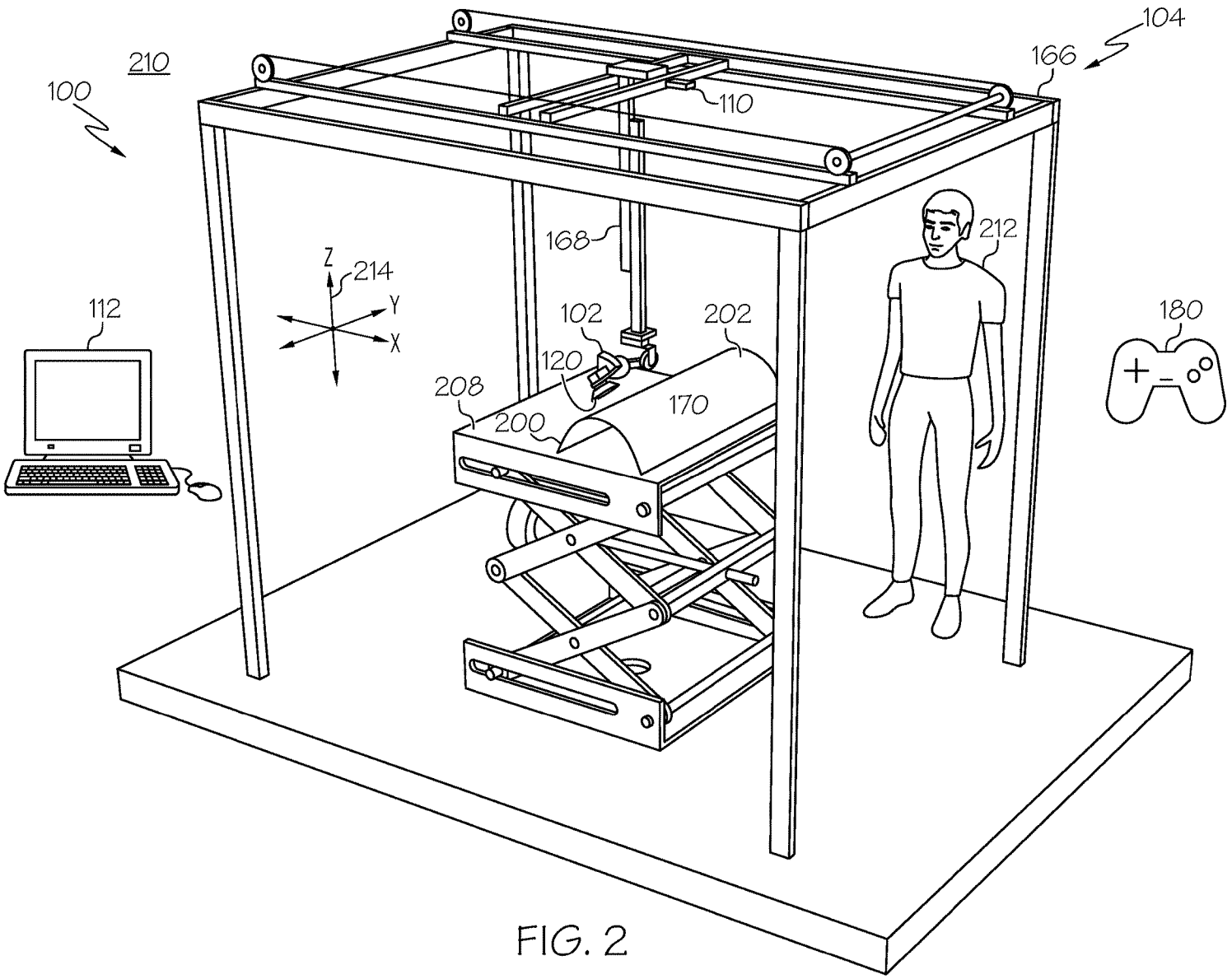
FIG. 2 is a schematic illustration of an example of the system in the operating environment.

Referring to FIG. 1, during the sanding operation, a spatial position of the sanding tool 102 in three-dimensional space may be defined by a spatial location 186 (e.g., an XYZ location) of the sanding tool 102 and an angular spatial orientation 188 (e.g., pitch, yaw, and roll) of the sanding tool 102, for example, relative to an environment reference frame 214 (FIG. 2). Generally, the spatial location 186 and the spatial orientation 188 of the sanding tool 102 correspond to a respective spatial location and angular spatial orientation of the abrasive surface 120.

For the purpose of the present disclosure, the term "spatial location" of an item refers to a location of the item in three-dimensional space relative to a reference frame. For the purpose of the present disclosure, the term "spatial orientation" of an item refers to an angular orientation of the item in three-dimensional space relative to a reference frame. Throughout the present disclosure, the spatial location and spatial orientation of an item may be referred to collectively as the "spatial position" of that item in three-dimensional space relative to a reference frame.

For the purpose of this disclosure, the sanding position refers to a particular spatial location 186 (FIG. 1) of the sanding tool 102 and a particular spatial angular orientation 188 (FIG. 1) of the sanding tool 102. The spatial location 186 of the sanding tool 102 in the sanding position locates the abrasive surface 120 in direct or physical contact with the surface 202. The spatial orientation 188 of the sanding tool 102 in the sanding position angularly orients the sanding axis 170 approximately normal to the surface 202, which places the abrasive surface 120 in flush contact with the surface 202 and evenly applies a sanding pressure to the surface 202. Generally, the sanding tool 102 is in, or is moved to, the sanding position during the sanding operation or when the sanding tool 102 is actuated to sand the surface 202.

The sanding tool 102 is any one of various types of automated or power sanders. In an example, the sanding tool 102 is an orbital sander and the abrasive surface 120 is a sanding disk. In an example, the sanding tool 102 is a random-orbit sander and the abrasive surface 120 is a sanding disk. In an example, the sanding tool 102 is a belt sander and the abrasive surface 120 is a sanding belt. In an example, the sanding tool 102 is a vibrating sander and the abrasive surface is a sanding pad. Additionally, the sanding tool 102 may be any other suitable type of polishing tool, smoothing tool, or roughening tool.

The robotic manipulator 104 is any one of various types of computer-programmable machines. In an example, the robotic manipulator 104 is fully autonomous, such as being capable of operation without real-time input from a human operator 212 (FIGS. 1 and 2). In an example, the robotic manipulator 104 is semi-autonomous, such as relying at least in part from real-time input from the human operator 212.

The robotic manipulator 104 has a number of degrees of freedom 172 (FIG. 1). The number of degrees of freedom 172 enables the robotic manipulator 104 to specify its pose corresponding to the spatial location 186 and/or the spatial orientation 188 of the sanding tool 102 relative to the structure 200 having various shapes, geometries, and/or contours of the surface 202. In an example, the robotic manipulator 104 has at least five degrees of freedom. Five degrees of freedom enables the robotic manipulator 104 to spatially position the sanding tool 102 and move the sanding tool 102 relative to the surface 202 having an arbitrary curve.

In an example, the robotic manipulator 104 has at least six degrees of freedom. Six degrees of freedom enables the system 100 to use of a belt sander as the sanding tool 102.

In an example, the robotic manipulator 104 has at least seven degrees of freedom. Seven degrees of freedom enables redundancy in the spatial positioning of the sanding tool 102 and enables a certain or particular pose of the robotic manipulator 104 to be selected from a set of all poses, which in turn spatially locates the sanding tool 102 at the desired location relative to the surface 202 of the structure 20. Seven degrees of freedom may also reduce the number of or avoid kinematic singularities and allows more desirable joint configurations of the robotic manipulator.

Referring generally to FIG. 1 and particularly to FIG. 2, in an example, the robotic manipulator 104 includes a gantry 166 and a robotic arm 168 coupled to the gantry 166. In an example, the gantry 166 has three degrees of freedom and the robotic arm 168 has four degrees of freedom. Use of the gantry 166 enables the sanding tool 102 to efficiently move across large areas of the surface 202 while using a reasonably small and compact robotic arm 168.

In an example, the gantry 166 facilitates selective movement of the robotic arm 168 in directions along three axes, such as along the X-axis, the Y-axis, and the Z-axis of the environment reference frame 214. In an example, the robotic arm 168 includes a base coupled to the gantry 166, one or more movable arm segments, and one or more actuators (e.g., servomotors) that are operable to move the various movable arm segments. The robotic arm 168 may include any number of movable arm segments so that any desirable range of rotational and/or translational movement of the sanding tool 102 relative to the surface 202 of the structure 200 is provided.

Alternatively, in an example, the robotic manipulator 104 includes only the robotic arm 168 having a sufficient number of degrees of freedom so that any desirable range of rotational and/or translational movement of the sanding tool 102 relative to the structure 200 is provided.

Figure 5:
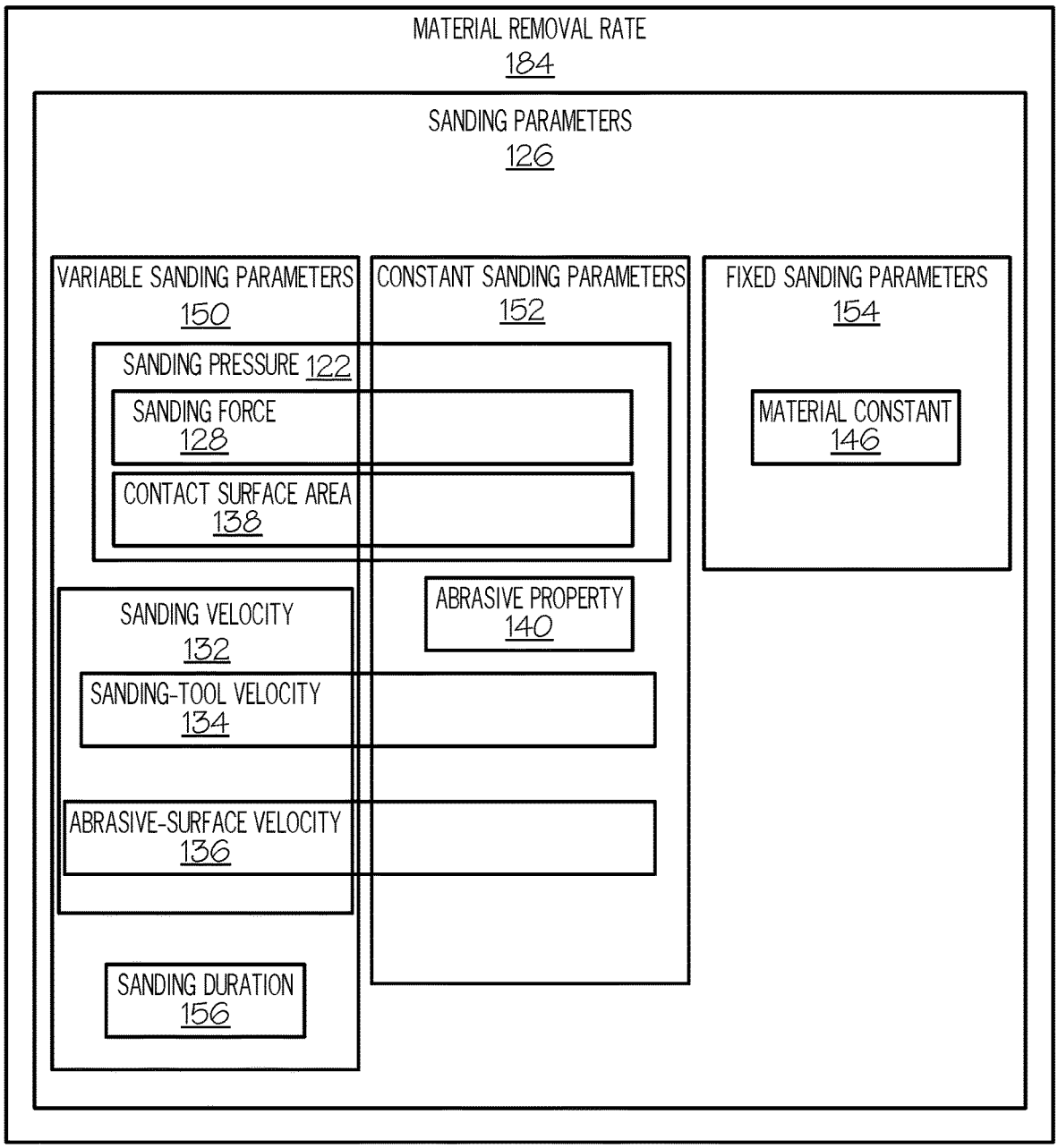
FIG. 5 is a schematic block diagram illustrating a material removal rate as a function of a plurality of sanding parameters.

Referring generally to FIG. 1 and particularly to FIG. 5, in an example, a material removal rate 184 is a function of a plurality of the sanding parameters 126. For the purpose of the present disclosure, the phrase "function of" refers to or represents a relationship involving one or more variables. For the purpose of the present disclosure, the term "parameter" refers to a characteristic, factor, or variable that determines a specific function or a desired result. The material removal rate 184 is an example of, or is representative of, both the model material removal rate 124 and the actual material removal rate 160 (FIG. 1). Accordingly, each one of the model material removal rate 124 and the actual material removal rate 160 is a function of the plurality of sanding parameters 126. The model material removal rate 124 is a function of the sanding parameters 126 (e.g., model sanding parameters), each having a parameter value that is selected to achieve the desired rate of material removal. The actual material removal rate 160 is a function of the sanding parameters 126 (e.g., actual sanding parameters), one or more of the sanding parameters 126 having a parameter value that is measured, or otherwise detected, during the sanding operation and that is selectively controlled to be approximately equal to the parameter value corresponding to or associated with the model material removal rate 124.

In an example, the plurality of sanding parameters 126 includes one or more variable sanding parameters 150. The variable sanding parameters 150 are parameters that are changeable and capable of being adjusted or modified during the sanding operation (e.g., are adaptable). Generally, the sanding parameters 126 that are monitored by the system 100 during the sanding operation include one or more of the variable sanding parameters 150.

In an example, the plurality of the sanding parameters 126 includes one or more constant sanding parameters 152. The constant sanding parameters 152 are parameters that are changeable, but are not capable of being adjusted or modified during the sanding operation (e.g., are not adaptable).

In an example, the plurality of the sanding parameters 126 includes one or more fixed sanding parameters 154. The fixed sanding parameters 154 are parameters that are not changeable.

In an example, the plurality of sanding parameters 126 includes a sanding force 128. The sanding force 128 is a force applied to the surface 202 of the structure 200 by the sanding tool 102, when the sanding tool 102 is in the sanding position, such as when the sanding tool 102 is stationary and when the sanding tool 102 moves across the surface 202. The sanding force 128 may be variable or constant (i.e., may be one of the variable sanding parameters 150 or one of the constant sanding parameters 152) based on the type of movement control of the robotic manipulator 104 used during the sanding operation.

In an example, the sanding force 128 is one of the variable sanding parameters 150. In other words, the sanding force 128 may be variable, such as when the surface 202 of the structure 200 has a variable geometry or a contour. In such an example, the sanding force 128 is one of the sanding parameters 126 that are monitored to determine the actual material removal rate 160 and selectively controlled to achieve the model material removal rate 124 during the sanding operation. For example, the robotic manipulator 104 may be configured to adjust the location of the sanding tool 102, for example, in directions perpendicular to the surface, and/or apply a variable pressure to the sanding tool 102. As such, the sanding force 128 is selectively controllable and is adjustable by control of the robotic manipulator 104.

Alternatively, in an example, the sanding force 128 is one of the constant sanding parameters 152. In other words, the sanding force 128 may be constant, such as when the surface 202 of the structure 200 has a constant geometry or is planar. In such an example, the sanding force 128 is a known variable for determination of the actual material removal rate 160, but is not one of the sanding parameters 126 that are monitored and selectively controlled during the sanding operation. For example, the robotic manipulator 104 may not be configured to adjust the location of the sanding tool 102, for example, in directions perpendicular to the surface, and/or apply a variable pressure to the sanding tool 102. As such, the sanding force 128 is fixed, but may be changed by using a different type of robotic manipulator 104.

In an example, the plurality of sanding parameters 126 includes a sanding pressure 122. The sanding pressure 122 is a pressure applied to the surface 202 of the structure 200 by the abrasive surface 120 of the sanding tool 102, when the sanding tool 102 is in the sanding position, such as then the sanding tool 102 is stationary and when the sanding tool 102 moves across the surface 202. The sanding pressure 122 includes, or is a function of, the sanding force 128 and a contact surface area 138 between the abrasive surface 120 and the surface 202 of the structure 200.

In an example, the contact surface area 138 is one of the constant sanding parameters 152. In other words, the contact surface area 138 may be constant, such as when the surface 202 of the structure 200 has a constant geometry or is planar. In such an example, the contact surface area 138 is a known variable for determination of the actual material removal rate 160, but is not one of the sanding parameters 126 that are monitored and selectively controlled during the sanding operation. In such an example, the contact surface area 138 is fixed, but may be changed by changing the dimensions of the abrasive surface 120 (e.g., by using a different type of sanding tool or a different type or size of abrasive surface).

Alternatively, in an example, the contact surface area 138 is one of the variable sanding parameters 150. In other words, the contact surface area 138 may be variable, such as when the surface 202 of the structure 200 has a variable geometry or a contour. In such an example, the contact surface area 138 is a determined (e.g., computationally ascertained or estimated) variable based on, or as a function of, a local contour, or localized geometry, of the surface 202 at a corresponding sanding location of the sanding tool 102, the sanding force 128 at the corresponding sanding location of the sanding tool 102, and abrasive properties of the abrasive surface 120 (e.g., a stiffness or deformation of the sanding pad). In such an example, the contact surface area 138 may be determined for each one of a plurality of sanding locations along a travel path (e.g., a sanding path 148) (FIG. 4) and used for determination of the actual material removal rate 160 at the corresponding, or respective, location. Such a determination may be performed prior to initiation of the sanding operation or in real-time during the sanding operation. The local contour or localized geometry of the surface 202 at each one of the sanding locations may be determined from a three-dimensional model of the structure 200 (e.g., three-dimensional model 204) (FIG. 1).

The sanding pressure 122 may be variable or constant (i.e., may be one of the variable sanding parameters 150 or one of the constant sanding parameters 152) depending on whether the sanding force 128 and/or the contact surface area 138 is variable or constant, as described herein.

In an example, when the sanding force 128 is variable, the sanding pressure 122 is one of the variable sanding parameters 150. In other words, the sanding pressure 122 may be variable, such as when the surface 202 of the structure 200 has a variable geometry or a contour. In such an example, the sanding pressure 122 is one of the sanding parameters 126 that are monitored to determine the actual material removal rate 160 and selectively controlled to achieve the model material removal rate 124 during the sanding operation.

Alternatively, in an example, when the sanding force 128 is constant, the sanding pressure 122 is one of the constant sanding parameters 152. In other words, the sanding pressure 122 may be constant, such as when the surface 202 of the structure 200 has a constant geometry or is planar. In such an example, the sanding pressure 122 is a known (e.g., computationally determined) variable for determination of the actual material removal rate 160, but is one of the sanding parameters 126 that are monitored and selectively controlled during the sanding operation.

In an example, the plurality of sanding parameters 126 includes a sanding-tool velocity 134. The sanding-tool velocity 134 is a velocity of the sanding tool 102 relative to the structure 200, when the sanding tool 102 moves across the surface 202 of the structure 200. The sanding-tool velocity 134 may be variable or constant (i.e., may be one of the variable sanding parameters 150 or one of the constant sanding parameters 152) based on the type of movement control of the robotic manipulator 104 (e.g., a variable speed movement control or a constant speed movement control) used during the sanding operation.

In an example, the sanding-tool velocity 134 is one of the variable sanding parameters 150. In such an example, the sanding-tool velocity 134 is one of the sanding parameters 126 that are monitored to determine the actual material removal rate 160 and selectively controlled to achieve the model material removal rate 124 during the sanding operation. For example, the robotic manipulator 104 may be configured to move at a variable speed. As such, the sanding-tool velocity 134 is selectively controllable and is adjustable by changing the movement speed setting of the robotic manipulator 104.

Alternatively, in an example, the sanding-tool velocity 134 is one of the constant sanding parameters 152. In such an example, the sanding-tool velocity 134 is a known variable for determination of the actual material removal rate 160, but is not one of the sanding parameters 126 that are monitored during the sanding operation. For example, the robotic manipulator 104 may be configured to move at a known constant speed. As such, the sanding-tool velocity 134 is fixed, but may be changed by using a different type of robotic manipulator 104 having a different movement speed.

In an example, the plurality of sanding parameters 126 includes an abrasive-surface velocity 136. The abrasive-surface velocity 136 is a velocity of the abrasive surface 120 relative to the sanding tool 102, when the sanding tool 102 is stationary and when the sanding tool 102 moves across the surface 202 of the structure 200. The abrasive-surface velocity 136 may be variable or constant (i.e., may be one of the variable sanding parameters 150 or one of the constant sanding parameters 152) based on the type of sanding tool 102 (e.g., a variable speed sander or a constant speed sander) used during the sanding operation.

In an example, the abrasive-surface velocity 136 is one of the variable sanding parameters 150. In such an example, the abrasive-surface velocity 136 is one of the sanding parameters 126 that are monitored to determine the actual material removal rate 160 and selectively controlled to achieve the model material removal rate 124 during the sanding operation. For example, the sanding tool 102 may be a variable speed sander. As such, the abrasive-surface velocity 136 is selectively controllable and is adjustable by changing the speed setting of the sander.

Alternatively, in an example, the abrasive-surface velocity 136 is one of the constant sanding parameters 152. In such an example, the abrasive-surface velocity 136 is a known variable for determination of the actual material removal rate 160, but is not one of the sanding parameters 126 that are monitored and selectively controlled during the sanding operation. For example, the sanding tool 102 may be a constant speed sander. As such, the abrasive-surface velocity 136 is fixed, but may be changed by using a different type of sander having a different constant speed.

In an example, the plurality of sanding parameters 126 includes a sanding velocity 132 of the sanding tool 102. The sanding velocity 132 is a combination of, or is a function of, both the sanding-tool velocity 134 and the abrasive-surface velocity 136 (e.g., a combined velocity of the sanding tool 102 representing more than one velocity parameter), when the sanding tool 102 is in the sanding position. In an example, the sanding velocity 132 is one of the variable sanding parameters 150. In an example, the sanding velocity 132 is one of the sanding parameters 126 that are monitored to determine the actual material removal rate 160 and selectively controlled to achieve the model material removal rate 124 during the sanding operation.

In an example, the plurality of sanding parameters 126 includes a sanding duration 156. The sanding duration is the period of time the sanding tool 102 works on a particular location on the surface 202. The sanding duration 156 may be variable or constant (i.e., may be one of the variable sanding parameters 150 or one of the constant sanding parameters 152) based on the type of the sanding operation performed on a particular sanding location on the surface and/or whether the sanding-tool velocity 134 is variable.

In an example, the sanding duration 156 is one of the variable sanding parameters 150. In such an example, the sanding duration 156 is one of the sanding parameters 126 that are monitored to determine the actual material removal rate 160 and selectively controlled to achieve the model material removal rate 124 during the sanding operation.

Alternatively, in an example, the sanding duration 156 is one of the constant sanding parameters 152. In such an example, the sanding duration 156 is a known variable for determination of the actual material removal rate 160, but is not one of the sanding parameters 126 that are monitored and selectively controlled during the sanding operation.

In an example, the plurality of sanding parameters 126 includes an abrasive property 140 (or a plurality of abrasive properties) of the abrasive surface 120. The abrasive property 140 may include any one or more of the type of particles of abrading materials of the abrasive surface 120, the grit size of the particles of abrading materials, the stiffness of the abrasive surface 120, and the like. Generally, the abrasive property 140 is constant (i.e., may be one of the constant sanding parameters 152) based on the type of abrasive surface 120 used during the sanding operation.

In an example, the abrasive property 140 is one of the constant sanding parameters 152. In such an example, abrasive property 140 is a known variable for determination of the actual material removal rate 160, but is not one of the sanding parameters 126 that are monitored and selectively controlled during the sanding operation. For example, the abrasive property 140 of the abrasive surface 120 may be fixed, but may be changed by using a different type of abrasive surface 120 with a different abrasive property 140.

It can be appreciated that as the abrasive surface 120 may wear down during use or deteriorate over time. As the abrasive surface 120 deteriorates, one or more of the abrasive properties 140 may change. As such, in an example, the abrasive property 140 may vary during the sanding operation based on wear of the abrasive surface 120. In such an example, deterioration of the abrasive surface (e.g., a change in one or more of the abrasive properties 140) may be monitored (e.g., in real time) and determined during the sanding operation or may be computationally predetermined based on various parameters of the sanding operation. In an example, the system 100 includes a force/torque sensor that measures frictional forces of sanding to determine a coefficient of friction in real time. The coefficient of friction may be proportional to an experimentally determined material constant (e.g., material constant 146) (FIG. 5). In such an example, when the determined coefficient of friction is below a predetermined threshold, the system 100 may provide an indication or alert that the abrasive surface 120 needs to be replaced. In an example, the system 100 includes a temperature sensor that measures a temperature of the abrasive surface 120. In such an example, when the measured temperature exceeds a predetermined threshold (i.e., more energy is used to heat the pad rather than sand the surface), the system 100 may provide an indication or alert that the abrasive surface 120 needs to be replaced.

In an example, the plurality of sanding parameters 126 include the material constant 146 corresponding to the structure 200 or the surface 202 of the structure 200. Generally, the material constant 146 is fixed (i.e., may be one of the fixed sanding parameters 154) based on the type of type of material making up the structure 200. For example, the material constant 146 may be at least partially based on the composition and/or the properties of the material making up, or otherwise forming, the structure 200 or the surface 202 of the structure 200. In an example, the material constant 146 may represent the density of the material being sanded and the like.

In an example, the material constant 146 is one of the fixed sanding parameters 154. In such an example, the material constant 146 is a known variable for determination of the actual material removal rate 160, but is not one of the sanding parameters 126 that are monitored and selectively controlled during the sanding operation.

The material constant 146 may be an experimentally determined constant or a computationally determined constant. Without being limited to any particular theory, the material removal rate 184 (FIG. 5), for example, representing the model material removal rate 124 (FIG. 1) and the actual material removal rate 160 (FIG. 1), may be represented by the following equation:

$$dv=kp*w/u$$

Wherein, dv is the material removal rate 184 (e.g., the volume of material removed by sanding), kp is the material constant 146, w is the work performed by the sanding tool 102, and u is the coefficient of friction of the surface 202. The work performed by the sanding tool 102 may be function of the sanding force 128, the sanding velocity 134 (e.g., one or more of the sanding-tool velocity 134 and/or the abrasive surface velocity 136), the contact surface area 138, and the sanding duration 156.

Generally, at least one of or, in some implementations, all of the variable sanding parameters 150 (FIG. 5) are the sanding parameters 126 that are monitored to determine the actual material removal rate 160 during the sanding operation. As such, the variable sanding parameters 150 are also the sanding parameters 126 that are selectively controlled during the sanding operation to achieve the actual material removal rate 160 (FIG. 1) being approximately equal to the model material removal rate 124 (FIG. 1) during the sanding operation.

Figure 3:
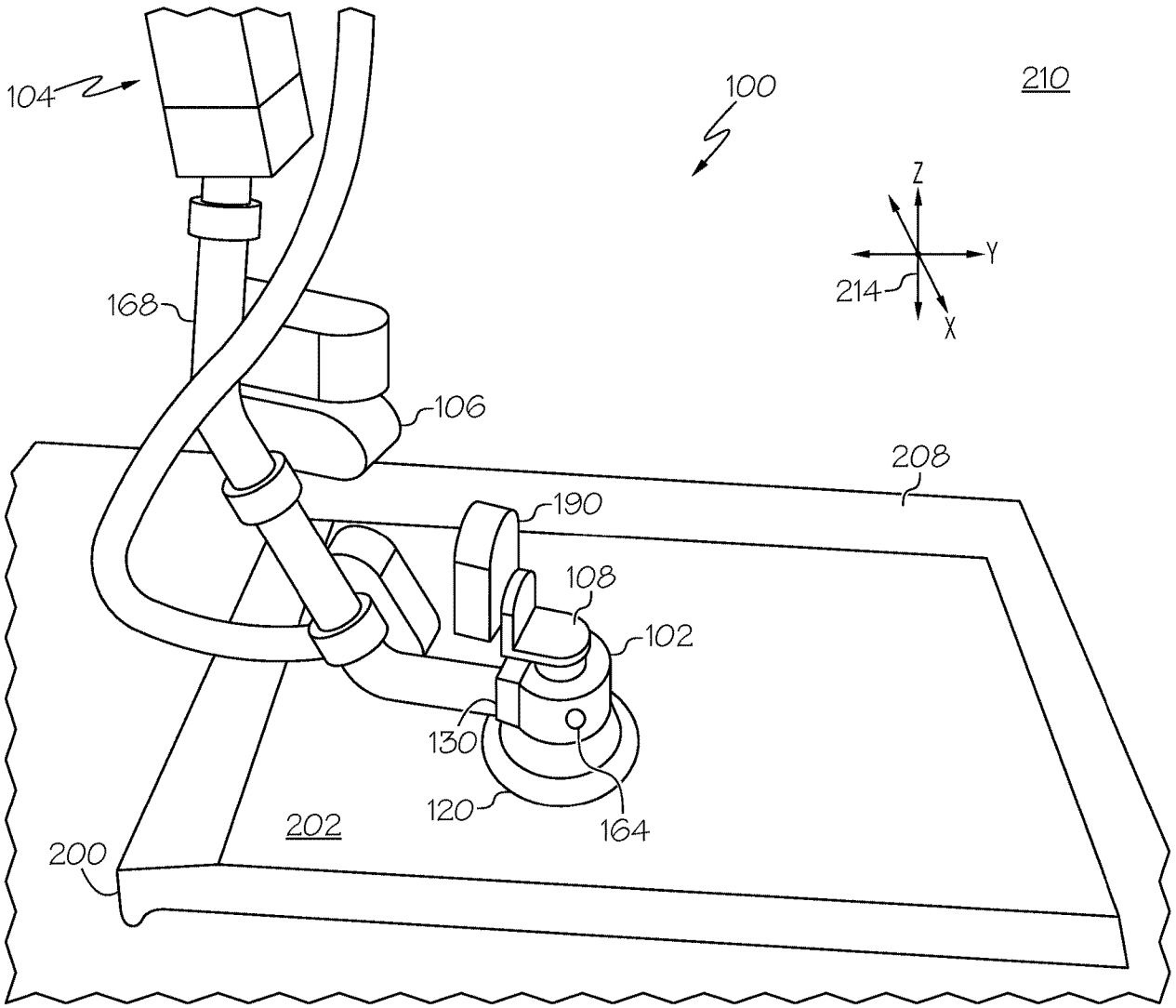
FIG. 3 is a schematic, perspective view of an example of a portion of the system sanding the surface of the structure.
Figure 4:
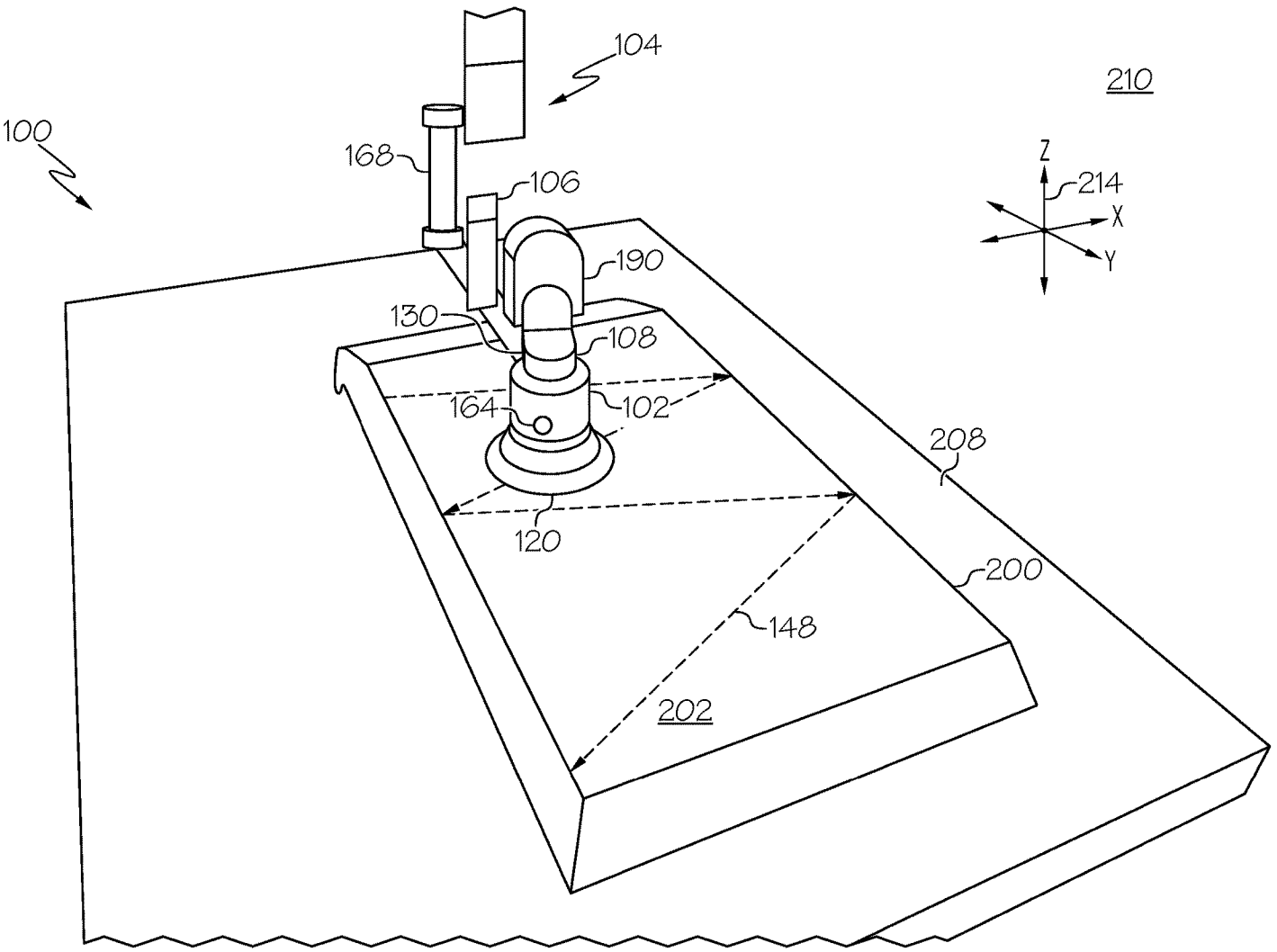
FIG. 4 is a schematic, perspective view of an example of a portion of the system sanding the surface of the structure.

Referring generally to FIG. 1 and particularly to FIGS. 2-4, the control unit 112 is operable (e.g., configured) to control (e.g., command based on instructions) movement of the sanding tool 102 to the sanding position. The control unit 112 is also operable to control movement of the sanding tool 102 across the surface 202 along the sanding path 148, while the sanding tool 102 is in the sanding position, or while keeping the sanding tool 102 in the sanding position. In an example, the control unit 112 selectively controls movement of the robotic manipulator 104. Selective movement of the robotic manipulator 104 enables the sanding tool 102 to be selectively positioned, such as in the sanding position, and selectively moved across the surface 202, such as along the sanding path 148 (FIGS. 1 and 4).

In an example, the system 100 includes the number of sensors 176 (FIG. 1). For the purpose of the present disclosure, the phrase "a number of" items means one or more of the items. The sensors 176 are communicatively coupled with the control unit 112. The sensors 176 are configured to detect a condition (representing a parameter value) of one or more of the sanding parameters 126. The sensors 176 may be configured to continuously detect the condition of one or more of the sanding parameters 126 or regularly detect the condition of one or more of the sanding parameters 126.

The control unit 112 is operable to monitor one or more of the sanding parameters 126, when the sanding tool 102 is in the sanding position, such as when the sanding tool 102 is stationary and when the sanding tool 102 moves across the surface 202 along the sanding path 148. The control unit 112 analyzes or evaluates a sensor output (e.g., parameter data) generated, or provided, by the sensors 176 and computationally determines the actual material removal rate 160 based on parameter values of the sanding parameters 126 being monitored. The control unit 112 is operable to regularly determine (e.g., estimate or ascertain) the actual material removal rate 160, while the sanding tool 102 is in the sanding position and while the sanding tool 102 moves across the surface 202 along the sanding path 148, based on one or more of the sanding parameters 126 being monitored. In an example, the control unit 112 continuously receives or regularly receives the parameter data from the number of sensors 176 detecting the condition of one or more of the sanding parameters 126.

For the purpose of the present disclosure, the term "regularly," such as in reference to regularly performing an action, activity, or operation, means that the action, activity, or operation is performed repeatedly at predefined times or at regular intervals, such as time intervals, spatial intervals, or activity intervals. In an example, the predefined intervals are temporally separated or interrupted by a predefined time period or action such that the term "regularly" may refer to the action, activity, or operation being performed, ceased for a predefined interval, and performed again. In an example, the predefined intervals are in immediate connection or uninterrupted in time such that the term "regularly" may also refer to the action, activity, or operation being performed continuously or without cessation.

The control unit 112 is operable to control modification or adjustment of one or more of the sanding parameters 126, while the sanding tool 102 is in the sanding position and while the sanding tool 102 moves across the surface 202 along the sanding path 148, so that the actual material removal rate 160 is approximately equal to the model material removal rate 124 and/or so that the actual material removal rate 160 is consistent along the sanding path 148. In an example, the control unit 112 selectively controls one or more operational function of the robotic manipulator 104 and/or the sanding tool 102 to modify a respective sanding parameter 126 that corresponds to the operational function being controlled.

Therefore, the sensors 176 detect, or measure, one or more of the sanding parameters 126 and the control unit 112 selectively controls modification of one or more of the sanding parameters when the sanding tool 102 is stationary and when the sanding tool 102 is moving. Throughout the present disclosure, the sanding tool 102 is generally described as being stationary during the sanding operation when the sanding tool 102 is being held in the sanding position and is not being moved across the surface 202 by the robotic manipulator 104. Further, the sanding tool 102 is generally described as moving during the sanding operation when the sanding tool 102 is being maintained in the sanding position and is being moved across the surface 202 by the robotic manipulator 104 along the sanding path 148

Accordingly, the sanding system 100 advantageously provides for a consistent rate of material removal to be achieved (i.e., the actual material removal rate 160 is consistently maintained approximately equal to the model material removal rate 124) via regularly monitoring and automatically modifying one or more of the sanding parameters 126, when the sanding tool 102 moves across the surface 202 along the sanding path 148. Utilization of a consistent material removal rate provides for a more consistent material-removal depth when moving a sanding tool across a surface as compared to a sanding operation that utilizes a constant sanding force.

Referring generally to FIG. 1, each one of the sensors 176 is configured to measure, or otherwise detect, a condition of a corresponding one of the sanding parameters 126 being monitored. For example, the sensors 176 may measure one or more of the sanding force 128, the sanding velocity 132, the sanding-tool velocity 134, and the abrasive-surface velocity 136. The control unit 112 is operable to ascertain parameter values representing one or more of the sanding parameters 126 from the measurements provided by the sensors 176 and associated with the corresponding sanding parameters 126 being monitored. The control unit 112 is also operable to process the measurements taken by the sensors 176 to determine a change in the condition of (e.g., whether or not a change in condition has occurred for) one or more of the sanding parameters 126, based on a comparison between an instantaneous measurement and at least one prior measurement (e.g., a window or set of previous measurements).

As generally illustrated in FIG. 1, in an example, one or more of the sensors 176 is operatively coupled with the robotic manipulator 104 to monitor one or more of the sanding parameters 126 associated with, or corresponding to, operation of the robotic manipulator 104, such as the sanding-tool velocity 134 and/or the sanding force 128. In an example, one or more of the sensors 176 is operatively coupled with the sanding tool 102 to monitor one or more of the sanding parameters 126 associated with, or corresponding to, operation of the sanding tool 102, such as the abrasive-surface velocity 136 and/or the sanding force 128. In an example, the sensors 176 are operatively coupled with the robotic manipulator 104 and the sanding tool 102 to monitor one or more of the sanding parameters 126 associated with, or corresponding to, operation of the robotic manipulator 104 and operation of the sanding tool 102. Examples of the number of sensors 176 include a force sensor 108, an abrasive-surface velocity sensor 164, a torque sensor 130, a temperature sensor, and any other type of suitable sensors.

Referring to FIGS. 1-3 and 5, in an example, the sanding force 128, applied to the surface 202 of the structure 200 by the sanding tool 102 is variable (i.e., is one of the variable sanding parameters 150) (FIG. 5) and is selectively controlled during the sanding operation. As such, one of the sanding parameters 126 being monitored is the sanding force 128. In such an example, the force sensor 108 (FIGS. 1,3, and 4) detects the sanding force 128 and the control unit 112 is operable to control adjustment of the sanding force 128 until the actual material removal rate 160 is approximately equal to the model material removal rate 124 when the sanding tool 102 is in the sanding position.

Detecting and using the sanding force 128 as a feedback measurement enables the system 100 to computationally determine the actual material removal rate 160, as a function of the sanding force 128, and maintain a consistent material removal rate via selective control and adjustment of the sanding force 128 so that the actual material removal rate 160 is approximately equal to the model material removal rate 124. Advantageously, the force sensor 108 enables the system 100 to regularly sample the sanding force 128 applied to the surface 202 and provide real-time feedback of the sanding force 128 during the sanding operation. The force sensor 108 also enables the system 100 to ascertain the sanding pressure 122 applied to the surface 202 and provide real-time feedback of the sanding pressure 122 during the sanding operation.

Additionally, the model material removal rate 124 desired for (or corresponding to) one location on the surface 202 or one portion of the sanding path 148 may differ from the model material removal rate 124 desired for (or corresponding to) another location on the surface 202 or another portion along the sanding path 148. Detecting, by the force sensor 108, and using the sanding force 128 as a feedback measurement, also enables the system 100 to selectively adjust, or vary, the sanding force 128, and in turn the sanding pressure 122, to achieve a particular actual material removal rate 160 corresponding to the model material removal rate 124 desired for a particular location on the surface 202 or a particular portion of the sanding path 148.

As illustrated in FIGS. 1, 3, and 4, in an example, the force sensor 108 is operatively coupled with the sanding tool 102 and communicatively coupled with the control unit 112. The force sensor 108 is configured to detect, or measure, the sanding force 128, applied to the surface 202 of the structure 200 by the sanding tool 102. The force sensor 108 is an example of one of the sensors 176 (FIG. 1).

In an example, the force sensor 108 is configured to generate sanding-force data, as a force-sensor output, representing a magnitude of the sanding force 128 applied to the surface 202 by the sanding tool 102 (i.e., the actual sanding-force value). In an example, the force sensor 108 continuously detects, or measures, the force sensor 108 and continually generates the sanding-force data during the sanding operation. In another example, the force sensor 108 regularly samples the sanding force 108 and regularly generates the sanding-force data.

The control unit 112 is operable to determine the sanding force 128 based on the force-sensor output from the force sensor 108. In an example, the control unit 112 determines (e.g., estimates or ascertains) the magnitude of the sanding force 128 from analysis of the sanding-force data and detects any change in the magnitude of the sanding force 108, during the sanding operation.

In an example, the system 100 includes a plurality of force sensors 108. Each one of the force sensors 108 is operatively coupled with the sanding tool 102 and communicatively coupled with the control unit 112. The force sensors 108 are configured to detect the sanding force 128, applied to the surface 202 of the structure 200 by the sanding tool 102. The control unit 112 is operable to ascertain the sanding force 128 based on force-sensor outputs from the force sensors 108. Use of a plurality of the force sensors 108 may provide redundancy in detection of the sanding force 128 (FIG. 5) and may improve accuracy of actual material removal rate 160 (FIG. 1) determined during the sanding operation. Reference herein to examples of the system 100 that include one force sensor 108 is not meant to exclude examples of the system 100 that include more than one force sensor 108.

In an example, the force sensor 108 is operatively coupled between the robotic manipulator 104 and the sanding tool 102. In an example, the force sensor 108 is operatively coupled between movable segments of the robotic manipulator 104, such as at a joint between the movable segments. In an example, at least one force sensor 108 is operatively coupled between the robotic manipulator 104 and the sanding tool 102 and at least one force sensor 108 is operatively coupled between movable segments of the robotic manipulator 104.

In an example, the force sensor 108 is a robot joint force sensor operatively coupled with a movable joint of the robotic manipulator 104 and/or with a joint between the sanding tool 102 and the robotic manipulator 104. In an example, the force sensor 108 is a force torque sensor. In an example, the force sensor 108 is a multi-axis (e.g., 6-axis) force torque sensor operatively coupled with a movable joint of the robotic manipulator 104. Referring generally to FIGS. 1-5, in an example, selective adjustment of the sanding force 128 (FIG. 5) is achieved by moving the sanding tool 102 in a direction approximately perpendicular to the surface 202 of the structure 200. In such an example, the control unit 112 is operable to control movement of the sanding tool 102 in the direction approximately perpendicular to the surface 202 of the structure 200, such as approximately along the Z-axis of the environment reference frame 214 (FIG. 2), to adjust the sanding force 128. As such, movement of the sanding tool 102 in the direction approximately perpendicular to the surface 202 facilitates selective control of the sanding force 128 by increasing or decreasing the sanding force 128 resulting from a change in the spatial location 186 (FIG. 1) of the sanding tool 102 closer to or farther from the surface 202 so that the sanding force 128 is sufficient to achieve the model material removal rate 124. Selective control of the sanding force 128 also facilitates selective control of the sanding pressure 122. The control unit 112 may selectively control and/or adjust the sanding force 128 by controlling the spatial location 186 of the sanding tool 102 in the direction approximately perpendicular to the surface 202, when the sanding tool 102 is stationary and when the sanding tool 102 is moving along the sanding path 148 (FIG. 4).

In an example, the control unit 112 instructs the robotic manipulator 104 to linearly move the sanding tool 102 in the direction approximately perpendicular to the surface 202 of the structure 200 to increase or decrease the magnitude of the sanding force 128 applied to the surface 202. Linear movement of the sanding tool 102, in the direction approximately perpendicular to the surface 202 of the structure 200, enables selective control of the sanding force 128, applied to the surface 202 by the sanding tool 102, by increasing or decreasing the magnitude of the sanding force 128 resulting from a change in spatial location 186 of the sanding tool 102 closer to or farther from the surface 202. The spatial location 186 of the sanding tool 102 is adjusted until the magnitude of the sanding force 128 is sufficient to achieve the model material removal rate 124, for example, until the actual material removal rate 160 is approximately equal to the model material removal rate 124.

As illustrated in FIGS. 3 and 4, in another example, the system 100 may include an actuator 190. The actuator 190 is operatively coupled with the sanding tool 102 and is configured to selectively adjust the sanding force 128 (FIG. 5) by command from the control unit 112. In an example, the actuator 190 may selectively move the sanding tool 102 relative to the robotic manipulator 104 and the surface 202, which in turn adjusts the spatial location 186 (FIG. 1) of the sanding tool 102 in the direction approximately perpendicular to the surface 202 and, thus, adjusts the sanding force 128, without requiring further movement of the robotic manipulator 104. In such an example, the actuator 190 may be a variable linear actuator, such as a pneumatic actuator or other pneumatic device driven by a variable pressure source.

In an example of the disclosed sanding operation when the sanding force 128 is monitored and selectively modified (i.e., when the sanding force 128 is variable), a model sanding-force value (e.g., theoretical or threshold parameter value) of the sanding force 128 is determined (e.g., computationally) that achieves the model material removal rate 124. During the sanding operation, the force sensor 108 detects the sanding force 128 and the control unit 112 determines an actual sanding-force value (e.g., measured or instantaneous parameter value) of the sanding force 128. The control unit 112 then compares the actual sanding-force value to the model sanding-force value. The control unit 112 selectively controls adjustment of the sanding force 128, as needed, until the actual material removal rate 160 is approximately equal to the model material removal rate 124. The force sensor 108 may measure the sanding force 128 and the control unit 112 may monitor the sanding force 128 (e.g., detect a change in the sanding force 128) and selectively control adjustment of the sanding force 128, as needed, when the sanding tool 102 is stationary and when the sanding tool 102 is moving.

When the actual sanding-force value, for example, represented by an instantaneous measurement, is approximately equal to the model sanding-force value, the sanding operation continues without modification of the sanding force 128 (i.e., the sanding operation continues at the currently applied sanding force 128). For example, when the actual sanding-force value is approximately equal to the model sanding-force value, the sanding operation continues without modification of the spatial location 186 of the sanding tool 102 in the direction approximately perpendicular to the surface 202 (i.e., the robotic manipulator 104 or the actuator 190 holds the sanding tool 102 in the current spatial location 186 relative to the surface 202).

When the actual sanding-force value, for example, represented by an instantaneous measurement, is less than the model sanding-force value, the control unit 112 selectively increases the sanding force 128 until the actual sanding-force value is approximately equal to the model sanding-force value, which in turn provides for the actual material removal rate 160 being approximately equal to the model material removal rate 124. For example, when the actual sanding-force value is less than the model sanding-force value, control unit 112 commands the robotic manipulator 104 or the actuator 190 to move the sanding tool 102 closer to the surface 202 to increase the sanding force 128 until the actual sanding-force value is approximately equal to the model sanding-force value, which in turn provides for the actual material removal rate 160 being approximately equal to the model material removal rate 124.

When the actual sanding-force value, for example, represented by an instantaneous measurement, is greater than the model sanding-force value, the control unit 112 decreases the sanding force 128 until the actual sanding-force value is approximately equal to the model sanding-force value, which in turn provides for the actual material removal rate 160 being approximately equal to the model material removal rate 124. For example, when the actual sanding-force value is greater than the model sanding-force value, the control unit 112 command the robotic manipulator 104 or the actuator 190 to move the sanding tool 102 farther from the surface 202 to decrease the sanding force 128 until the actual sanding-force value is approximately equal to the model sanding-force value, which in turn provides for the actual material removal rate 160 being approximately equal to the model material removal rate 124.

In one or more examples, the process described above is performed by operation of the control unit 112, for example, by execution of instructions in the form of program code and/or implementation of a software tool.

Referring to FIGS. 1-5, in an example, the sanding-tool velocity 134 of the sanding tool 102 relative to the structure 200 is variable (i.e., is one of the variable sanding parameters 150) (FIG. 5) and is selectively controlled during the sanding operation. As such, one of the sanding parameters 126 being monitored is the sanding-tool velocity 134. In such an example, the control unit 112 is operable to selectively control the movement speed of robotic manipulator 104, which in turn selectively controls adjustment of the sanding-tool velocity 134 until the actual material removal rate 160 is approximately equal to the model material removal rate 124. For example, the control unit 112 instructs the robotic manipulator 104 to move the sanding tool 102 across the surface 202 at a desired variable speed, for example, in a direction corresponding to the sanding path 148, to achieve the sanding-tool velocity 134.

In another example, the sanding-tool velocity 134 is constant (i.e., is one of the constant sanding parameters 152) (FIG. 5) and, as such, is not one of the sanding parameters 126 being monitored or selectively modified during the sanding operation. In such an example, the control unit 112 instructs the robotic manipulator 104 to move the sanding tool 102 across the surface 202 at a desired constant speed, for example, in the direction corresponding to the sanding path 148.

Detecting and using the sanding-tool velocity 134 as feedback enables the system 100 to computationally determine the actual material removal rate 160, as a function of the sanding-tool velocity 134, and maintain the consistent material removal rate via selective control and adjustment of the sanding-tool velocity 134 so that the actual material removal rate 160 is approximately equal to the model material removal rate 124.

Additionally, the model material removal rate 124 desired for (or corresponding to) one location on the surface 202 or one portion of the sanding path 148 may differ from the model material removal rate 124 desired for (or corresponding to) another location on the surface 202 or another portion along the sanding path 148. Determining the sanding-tool velocity 134 also enables the system 100 to selectively adjust, or vary, the sanding-tool velocity 134 to achieve a particular actual material removal rate 160 corresponding to the model material removal rate 124 desired for a particular location on the surface 202 or a particular portion of the sanding path 148.

The control unit 112 may computationally determine the actual sanding-tool-velocity value of the sanding-tool velocity 134 (e.g., the computed velocity of the sanding tool 102) based on one or more properties of the robotic manipulator 104, such as the selectively controlled movement of the robotic manipulator 104, an ascertained change in position of the robotic manipulator 104, and/or the speed of the robotic manipulator 104. In an example, the speed of the robotic manipulator 104 and, thus, the sanding-tool velocity 134 is computationally determined based on a change in a spatial position of the robotic manipulator 104 over time. In another example, the speed of the robotic manipulator 104 and, thus, the sanding-tool velocity 134 is computationally determined based on an integration of acceleration of the robotic manipulator 104 over time. In such an example, the system 100 includes a number of accelerometers (not shown) operatively coupled with the robotic manipulator 104. The accelerometers are configured to measure the acceleration of the robotic manipulator 104 and generate acceleration data as the robotic manipulator 104 moves the sanding tool 102 across the surface 202. The control unit 112 determines the speed of the robotic manipulator 104 by integrating the acceleration data over time (e.g., over a sampling period).

In an example of the disclosed sanding operation when the sanding-tool velocity 134 is monitored and selectively modified (i.e., when the sanding-tool velocity 134 is variable), a model sanding-tool-velocity value (e.g., theoretical or threshold parameter value) of the sanding-tool velocity 134 is determined (e.g., computationally) that achieves the model material removal rate 124. During the sanding operation, the sanding-tool velocity 134 is monitored and an actual sanding-tool-velocity value (e.g., instantaneous parameter value) of the sanding-tool velocity 134 is determined. The control unit 112 then compares the actual sanding-tool-velocity value to the model sanding-tool-velocity value. The control unit 112 may monitor and selectively adjust the sanding-tool velocity 134, as needed, until the actual material removal rate 160 is approximately equal to the model material removal rate 124 when the sanding tool 102 is moving.

When the actual sanding-tool-velocity value, for example, represented by an instantaneous measurement, is approximately equal to the model sanding-tool-velocity, the sanding operation continues without modification of the sanding-tool velocity 134 (i.e., the sanding operation continues using the currently applied sanding-tool velocity 134). For example, when the actual sanding-tool-velocity value, represented by an instantaneous speed of the robotic manipulator 104, is approximately equal to the model sanding-tool-velocity value, the sanding operation continues without modification of the speed of the robotic manipulator 104 (i.e., the sanding operation continues using the current movement speed of the robotic manipulator 104 and, thus, the current sanding-tool velocity 134).

When the actual sanding-tool-velocity is less than the model sanding-tool-velocity value, the control unit 112 selectively increases the sanding-tool velocity 134 until the actual sanding-tool-velocity value is approximately equal to the model sanding-tool-velocity value, which in turn provides for the actual material removal rate 160 being approximately equal to the model material removal rate 124. For example, when the actual sanding-tool-velocity value is less than the model sanding-tool-velocity value, control unit 112 selectively increases the movement speed of the robotic manipulator 104, thus, increasing the sanding-tool velocity 134, until the actual sanding-tool-velocity value is approximately equal to the model sanding-tool-velocity value, which in turn provides for the actual material removal rate 160 being approximately equal to the model material removal rate 124.

When the actual sanding-tool-velocity value is greater than the model sanding-tool-velocity value, the control unit 112 selectively decreases the sanding-tool velocity 134 until the actual sanding-tool-velocity value is approximately equal to the model sanding-tool-velocity value, which in turn provides for the actual material removal rate 160 being approximately equal to the model material removal rate 124. For example, when the actual sanding-tool-velocity value is greater than the model sanding-tool-velocity value, the control unit 112 decreases the movement speed of the robotic manipulator 104, thus, decreasing the sanding-tool velocity 134, until the actual sanding-tool-velocity value is approximately equal to the model sanding-tool-velocity value, which in turn provides for the actual material removal rate 160 being approximately equal to the model material removal rate 124.

In one or more examples, the process described above is performed by operation of the control unit 112, for example, by executing instructions in the form of program code and/or implementation of a software tool.

Referring to FIGS. 1-5, in an example, the abrasive-surface velocity 136 of the abrasive surface 120 relative to the sanding tool 102 is variable (i.e., is one of the variable sanding parameters 150) (FIG. 5) and is selectively controlled during the sanding operation. As such, one of the sanding parameters 126 being monitored is the abrasive-surface velocity 136. In such an example, the abrasive-surface velocity sensor 164 (FIGS. 1, 3, and 4) detects the abrasive-surface velocity 136 and the control unit 112 is operable to control adjustment of the abrasive-surface velocity 136 until the actual material removal rate 160 is approximately equal to the model material removal rate 124 when the sanding tool 102 is in the sanding position. For example, when the sanding tool 102 is a variable speed sander, the control unit 112 is operable to selectively control the operating speed of the sanding tool 102 to increase or decrease the abrasive-surface velocity 136. The control unit 112 instructs the sanding tool 102 to begin and cease sanding and to operate at a desired variable speed corresponding to the desired abrasive-surface velocity 136. Selective control of the speed of the sanding tool 102 facilitates selective control of the abrasive-surface velocity 136, at least to the degree achievable by the sanding tool 102 having variable speed control.

In another example, the abrasive-surface velocity 136 is constant (i.e., is one of the constant sanding parameters 152) (FIG. 5) and, as such, is not one of the sanding parameters 126 being monitored or selectively modified during the sanding operation. In such an example, the system 100 does not utilize the abrasive-surface velocity 136 and the control unit 112 is not operable to control adjustment of the abrasive-surface velocity 136. For example, the sanding tool 102 is a constant speed sander and the control unit 112 simply instructs the sanding tool 102 to begin and cease sanding.

Detecting and using the abrasive-surface velocity 136 as feedback enables the system 100 to computationally determine the actual material removal rate 160, as a function of the abrasive-surface velocity 136, and maintain the consistent material removal rate via selective control and adjustment of the abrasive-surface velocity 136 so that the actual material removal rate 160 is approximately equal to the model material removal rate 124. Advantageously, the abrasive-surface velocity sensor 164 enables the system 100 to regularly sample the abrasive-surface velocity 136 and provide real-time feedback during the sanding operation.

Additionally, the model material removal rate 124 desired for (or corresponding to) one location on the surface 202 or one portion of the sanding path 148 may differ from the model material removal rate 124 desired for (or corresponding to) another location on the surface 202 or another portion along the sanding path 148. Detecting, by the abrasive-surface velocity sensor 164, and using the abrasive-surface velocity 136 as a feedback measurement also enables the system 100 to selectively adjust, or vary, the abrasive-surface velocity 136 to achieve a particular actual material removal rate 160 corresponding to the model material removal rate 124 desired for a particular location on the surface 202 or a particular portion of the sanding path 148.

As illustrated in FIGS. 1, 3, and 4, in an example, the abrasive-surface velocity sensor 164 is operatively coupled with the sanding tool 102 and communicatively coupled with the control unit 112. The abrasive-surface velocity sensor 164 is configured to detect, or measure, the abrasive-surface velocity 136 of the abrasive surface 120 relative to the sanding tool 102. The abrasive-surface velocity sensor 164 is an example of one of the sensors (FIG. 1). In an example, the abrasive-surface velocity sensor 164 is configured to generate abrasive-surface-velocity data, as an abrasive-surface-velocity-sensor output, representing a speed of the abrasive surface 120 relative to the sanding tool 102 and/or the surface 202 (e., the actual abrasive-surface-velocity value). In an example, the abrasive-surface velocity sensor 164 continuously detects, or measures, the abrasive-surface velocity 136 and continually generates the abrasive-surface-velocity data during the sanding operation. In another example, the abrasive-surface velocity sensor 164 regularly samples the abrasive-surface velocity 136 and regularly generates the abrasive-surface-velocity data.

The control unit 112 is operable to determine the abrasive-surface velocity 136 based on the abrasive-surface-velocity-sensor output from the abrasive-surface velocity sensor 164. In an example, the control unit 112 determines (e.g., estimates or ascertains) the abrasive-surface velocity 136 from analysis of the abrasive-surface-velocity data and detects any change in the abrasive-surface velocity 136, during the sanding operation.

In an example, the abrasive-surface velocity sensor 164 is operatively coupled with one of a motor of the sanding tool 102, a drive shaft of the sanding tool 102, or the abrasive surface 120. In an example, the abrasive-surface velocity 134 is a rotational velocity of the abrasive surface 120 and the abrasive-surface velocity sensor 164 measures revolutions or oscillations of the abrasive surface 120 per unit time. In other examples, the abrasive-surface velocity 134 may be a non-rotational velocity (e.g., linear or reciprocal) of the abrasive surface 120 and the abrasive-surface velocity sensor 164 measures the relative movement of the abrasive surface 120 per unit time. The type of relative movement of the abrasive surface 120 and the type of measurement taken by the abrasive-surface velocity sensor 164 may depend, for example, on the type of sanding tool 102 used during the sanding operation.

In an example of the disclosed sanding operation when the abrasive-surface velocity 136 is variable, a model abrasive-surface-velocity value (e.g., theoretical or threshold parameter value) of the abrasive-surface velocity 136 is determined (e.g., computationally) that achieves the model material removal rate 124. During the sanding operation, the abrasive-surface velocity 136 is monitored and an actual abrasive-surface-velocity value (e.g., measured or instantaneous parameter value) of the abrasive-surface velocity 136 is determined. The control unit 112 then compares the actual abrasive-surface-velocity value to the model abrasive-surface-velocity value. The abrasive-surface velocity sensor 164 may measure the abrasive-surface velocity 136 and the control unit 112 may monitor the abrasive-surface velocity 136 (e.g., detect a change in the abrasive-surface velocity 136) and selectively adjust the abrasive-surface velocity 136, as needed, when the sanding tool 102 is stationary and when the sanding tool 102 is moving.

When the actual abrasive-surface-velocity value (e.g., a measured velocity of the abrasive surface 120), for example, represented by an instantaneous measurement, is approximately equal to the model abrasive-surface-velocity value, the sanding operation continues without modification of the abrasive-surface velocity 136 (i.e., the sanding operation continues at the currently applied abrasive-surface velocity 136). For example, when the actual abrasive-surface-velocity value is approximately equal to the model abrasive-surface-velocity value without modification of the variable speed control of the sanding tool 102 (i.e., the sanding tool 102 operates at the currently applied speed setting).

When the actual abrasive-surface-velocity value is less than the model abrasive-surface-velocity value, the control unit 112 selectively increases the abrasive-surface velocity 136 until the actual abrasive-surface-velocity value is approximately equal to the model abrasive-surface-velocity value, which in turn provides for the actual material removal rate 160 being approximately equal to the model material removal rate 124. For example, when the actual abrasive-surface-velocity value is less than the model abrasive-surface-velocity value, the control unit 112 commands the sanding tool 102 to increase its operating speed to increase the abrasive-surface velocity 136 until the actual abrasive-surface-velocity value is approximately equal to the model abrasive-surface-velocity value, which in turn provides for the actual material removal rate 160 being approximately equal to the model material removal rate 124.

When the actual abrasive-surface-velocity value is greater than the model abrasive-surface-velocity value, control unit 112 selectively decreases the abrasive-surface velocity 136 until the actual abrasive-surface-velocity value is approximately equal to the model abrasive-surface-velocity value, which in turn provides for the actual material removal rate 160 being approximately equal to the model material removal rate 124. For example, when the actual abrasive-surface-velocity value is greater than the model abrasive-surface-velocity value, the control unit 112 commands the sanding tool 102 to decreases its operating speed to decrease the abrasive-surface velocity 136 until the actual abrasive-surface-velocity value is approximately equal to the model abrasive-surface-velocity value, which in turn provides for the actual material removal rate 160 being approximately equal to the model material removal rate 124.

In one or more examples, the process described above is performed by operation of the control unit 112, for example, by executing instructions in the form of program code and/or implementation of a software tool.

Referring to FIGS. 1-5, in an example, both the sanding-tool velocity 134 and the abrasive-surface velocity 136 are variable (i.e., are ones of the variable sanding parameters 150) (FIG. 5) and are both selectively controlled during the sanding operation. As such, one of the sanding parameters 126 being monitored is the sanding velocity 132 of the sanding tool 102. As described above, the sanding velocity 132 includes a combination of, or is a function of, at least one of the sanding-tool velocity 134 and the abrasive-surface velocity 136. In such an example, the control unit 112 is operable to selectively control adjustment of the sanding velocity 132 (i.e., at least one of sanding-tool velocity 134 and/or the abrasive-surface velocity 136) until the actual material removal rate 160 is approximately equal to the model material removal rate 124.

Detecting and using the sanding velocity 132 as feedback enables the system 100 to computationally determine the actual material removal rate 160, as a function of the sanding-tool velocity 134 and the abrasive-surface velocity 136, and maintain the consistent material removal rate via selective control and adjustment of the sanding velocity 132 so that the actual material removal rate 160 is approximately equal to the model material removal rate 124.

The abrasive-surface velocity sensor 164 may measure the abrasive-surface velocity 136 and the control unit 112 may monitor the abrasive-surface velocity 136 and the sanding-tool velocity 134, and selectively adjust the abrasive-surface velocity 136 and the sanding-tool velocity 134, as needed, until the actual material removal rate 160 is approximately equal to the model material removal rate 124 when the sanding tool 102 is stationary and when the sanding tool 102 is moving.

In one or more examples, the system 100 is configured to monitor and selectively control a combination of different sanding parameters 126 so that the actual material removal rate 160 is approximately equal to the model material removal rate 124 during the sanding operation. For example, a plurality of the sensors 176 (FIG. 1), such as the force sensor 108 and the abrasive-surface velocity sensor 164, operate in combination to detect, or measure, a plurality (e.g., two or more) of the sanding parameters 126. The control unit 112 is operable to monitor the combination of the plurality of the sanding parameters 126 when the sanding tool 102 is stationary and when the sanding tool 102 is moving. The control unit 112 is further operable to determine the actual material removal rate 160, based on the sensor outputs from the sensors 176 representing the plurality of the sanding parameters 126 being monitored. The control unit 112 is also operable to selectively control modification of at least one of the combination of the sanding parameters 126, as needed, when the sanding tool 102 is stationary and/or when the sanding tool 102 is moving, so that the actual material removal rate 160 is approximately equal to the model material removal rate 124.

In an example, the sanding parameters 126 being monitored include at least one of the sanding force 128 and the (e.g., variable) abrasive-surface velocity 136 when the sanding tool 102 is in the sanding position and is stationary. The control unit 112 controls selective adjustment of at least one of the sanding force 128 and the abrasive-surface velocity 136, as needed, until the actual material removal rate 160 is approximately equal to the model material removal rate 124.

In another example, the sanding parameters 126 being monitored include at least one of the sanding force 128, the (e.g., variable) sanding-tool velocity 134, and the (e.g., variable) abrasive-surface velocity 136 when the sanding tool 102 is in the sanding position and moves across the surface 202, such as along the sanding path 148. The control unit 112 controls selective adjustment at least one of the sanding force 128, the sanding-tool velocity, and the abrasive-surface velocity 136, as needed, until the actual material removal rate 160 is approximately equal to the model material removal rate 124.

During the sanding operation, it may be desirable to consistently maintain the sanding force 128 at an orientation approximately normal to the surface 202 in addition to monitoring and adjusting the sanding parameters 126 so that the actual material removal rate 160 is approximately equal to the model material removal rate 124 (e.g., when moving the sanding tool 102 to the sanding position and/or when moving the sanding tool 102 across the surface 202). As such, in one or more examples, the system 100 includes means to consistently maintain the sanding force 128 approximately normal to the surface 202.

Referring to FIGS. 1-4 and 6, in an example, the system 100 includes the torque sensor 130. The torque sensor 130 is operatively coupled with the sanding tool 102 and communicatively coupled with the control unit 112. The torque sensor 130 is configured to detect, or measure, a torque applied to the sanding tool 102 by the surface 202 of the structure 200. In an example, the torque sensor 130 is an example of the number of sensors 176.

Advantageously, the torque sensor 130 enables the system 100 to regularly sample the torque applied to the sanding tool 102 and provide real-time feedback of torque during the sanding operation. Detection of the torque applied to the sanding tool 102 and adjustment of the spatial orientation 188 (FIG. 1) in response to a detected torque are used to correct for errors in the orientation of the sanding tool 102 and, thus, normalization errors of the sanding force 128 (FIG. 5). Correcting errors in the orientation of the sanding tool 102 in response to a detected torque consistently maintains the sanding axis 170 (FIGS. 2 and 6) of the sanding tool 102 and, thus, the sanding force 128 (FIG. 5) approximately normal to the surface 202 when the sanding tool 102 is in the sanding position, such as when the sanding tool 102 is stationary and when the sanding tool 102 is moving across the surface 202, such as along the sanding path 148 (FIG. 4). Correcting errors in the orientation of the sanding tool 102 in response to a detected torque also consistently maintains the abrasive surface 120 in approximately flush contact with the surface 202. Consistently maintaining the sanding axis 170 approximately normal to the surface 202 and the abrasive surface 120 in approximately flush contact with the surface 202 facilitates consistent performance of the system 100.

In an example, the torque sensor 130 is configured to generate torque data, as a torque-sensor output, representing a magnitude and a direction of the torque applied to the sanding tool 102 by the surface 202 (i.e., an actual or measured torque value). In an example, the torque sensor 130 continuously detects, or measures, the torque and continually generates the torque data during the sanding operation. In another example, the torque sensor 130 regularly samples the torque and regularly generates the torque data.

The control unit 112 is operable to determine the torque applied to the sanding tool 102 based on the torque-sensor output from the torque sensor 130. In an example, the control unit 112 determines (e.g., estimates or ascertains) the magnitude and direction of the torque from analysis of the torque data and detects any change in the magnitude and direction of the torque, during the sanding operation. The control unit 112 is also operable to control selective adjustment of the angular spatial orientation 188 (FIG. 1) of the sanding tool 102 based on the torque-sensor output from the torque sensor 130 so that the torque, applied to the sanding tool 102, is below a predetermined torque-threshold.

In an example, the system 100 includes a plurality of torque sensors 130. Each one of the torque sensors 130 is operatively coupled with the sanding tool 102 and communicatively coupled with the control unit 112. The torque sensors 130 are configured to detect the torque applied to the sanding tool 102 by the surface 202 of the structure 200. The control unit 112 is operable to ascertain the torque from the torque sensors 130. Reference herein to examples of the system 100 that include one torque sensor 130 is not meant to exclude examples of the system 100 that include more than one torque sensor 130.

As illustrated in FIGS. 1, 3, and 4, in an example, the torque sensor 130 is operatively coupled between the robotic manipulator 104 and the sanding tool 102. In another example, the torque sensor 130 is operatively coupled between movable segments of the robotic manipulator 104, such as at a joint between the movable segments. In another example, at least one torque sensor 130 is operatively coupled between the robotic manipulator 104 and the sanding tool 102 and at least one torque sensor 130 is operatively coupled between movable segments of the robotic manipulator 104.

In an example, the torque sensor 130 is a robot joint torque sensor operatively coupled with a movable joint of the robotic manipulator 104 and/or with a joint between the sanding tool 102 and the robotic manipulator 104.

In an example, the force sensor 108 and the torque sensor 130 are integrated or otherwise combined to form a force torque sensor configured to detect both the sanding force 128 applied to the surface 202 by the sanding tool 102 and the torque applied to the sanding tool 102 by the surface 202.

In an example of the disclosed the sanding operation when the torque is monitored and the spatial orientation 188 is selectively modified in response to the torque measurement, a torque-threshold value (e.g., a theoretical or threshold value) is selected or determined. Generally, the torque-threshold value is a maximum torque value that would indicate an error in normality of the sanding tool 102 and that would initiate an adjustment of the spatial orientation 188 of the sanding tool 102. During the sanding operation, the torque sensor 130 detects the torque and the control unit 112 determines an actual torque value (e.g., measured or instantaneous value) of the torque applied to the sanding tool 102. The control unit 112 then compares the actual torque value to a torque-threshold value. The control unit 112 selectively controls adjustment of the spatial orientation 188 (FIG. 1) of the sanding tool 102, as needed, until the actual torque value is within an acceptable tolerance to the torque-threshold value (e.g., until the actual torque value is equal to or below the torque-threshold value). The torque sensor 130 may measure the torque and the control unit 112 may monitor the torque (e.g., detect a change in the torque) and selectively control adjustment of the spatial orientation 188 of the sanding tool 102, as needed, when the sanding tool 102 is stationary and when the sanding tool 102 is moving.

When the actual torque value, represented by an instantaneous measurement, is within the acceptable tolerance to the torque-threshold value, the sanding operation continues without modification of the spatial orientation 188 of the sanding tool 102 (i.e., the sanding operation continues at the current spatial orientation 188 of the sanding tool 102 relative to the surface 202). For example, when the actual torque value is within the acceptable tolerance to the torque-threshold value, the sanding operation continues without a change in the pose of the robotic manipulator 104 (i.e., the sanding operation continues using the current pose of robotic manipulator 104 and/or without rotationally moving the sanding tool 102 relative to the robotic manipulator 104).

When the actual torque value, represented by an instantaneous measurement, is outside the acceptable tolerance to the torque-threshold value (e.g., greater than the torque-threshold value), the control unit 112 selectively adjusts the angular spatial orientation 188 of the sanding tool 102 until the actual torque value is within the acceptable tolerance to the torque-threshold value, which in turn spatially orients the sanding force 128 approximately normal to the surface 202. For example, when the actual torque value is outside the acceptable tolerance to the torque-threshold value, the control unit 112 commands the robotic manipulator 104 to adjust the spatial orientation 188 of the sanding tool 102 relative to the surface 202 until the actual torque value is within the acceptable tolerance to the torque-threshold value, which in turn spatially orients the sanding force 128 approximately normal to the surface 202.

In one or more examples, the process described above is performed by operation of the control unit 112, for example, by execution of instructions in the form of program code and/or implementation of a software tool. During the sanding operation, it may be desirable that the spatial position of the surface 202 and the spatial position of the sanding tool 102 be known, such as when moving the sanding tool 102 to the sanding position and/or when moving the sanding tool 102 across the surface 202 along the sanding path 148. A known spatial position of the surface 202 and a known spatial position of the sanding tool 102, for example, relative to the environment reference frame 214 (FIG. 1) and/or relative to each other, enable the system 100 to properly position the sanding tool 102 relative to the surface 202 during sanding. As such, in one or more examples, the system 100 includes means to ascertain the spatial position of the surface 202 and the spatial position of the sanding tool 102.

Referring generally to FIGS. 1 and 2 and particularly to FIGS. 3, 4, and 6-8, in an example, the control unit 112 is operable to determine the spatial position of the sanding tool 102 relative to the surface 202 of the structure 200. The control unit 112 is also operable to determine the spatial position (e.g., three-dimensional position) of the surface 202 of the structure 200. In an example, the spatial position of the surface 202 is determined based on the three-dimensional model 204 (FIGS. 1, 7, and 8) representing the structure 200 and, more particularly, the surface 202 of the structure 200. The control unit 112 is further operable to selectively control movement of the sanding tool 102 in the sanding position relative to the surface 202, based on the spatial position of the sanding tool 102 and the spatial position of the surface 202.

The spatial position of the sanding tool 102 relative to the environment reference frame 214 (FIGS. 3 and 4) may be computationally determined based on known or ascertained criteria, such as an ascertained pose of the robotic manipulator 104 (e.g., a spatial position of a working end of the robotic manipulator 104 to which the sanding tool 102 is attached), the known geometry of the robotic manipulator 104, the known geometry of the sanding tool 102, and/or the fixed position of the sanding tool 102 relative to the robotic manipulator 104, when coupled to the robotic manipulator 104.

As illustrated in FIG. 1, in an example, the system 100 includes one or more position sensors 106. The position sensors 106 are operatively coupled with the robotic manipulator 104 and communicatively coupled with the control unit 112. The position sensors 106 are configured to detect the pose, or a spatial position, of the robotic manipulator 104 relative to the environment reference frame 214. In an example, the position sensors 106 are an example of the number of sensors 176.

In an example, the position sensors 106 are configured to generate position data, as a position-sensor output, representing the position, or pose, of the robotic manipulator 104, for example, relative to the environment reference frame 214. In an example, the position sensors 106 continuously detect the position of the robotic manipulator 104 and continually generate the position data during the sanding operation. In another example, the position sensors 106 regularly sample the position of the robotic manipulator 104 and regularly generate the position data.

The control unit 112 is operable to computationally determine the spatial position of the sanding tool 102 based on the position-sensor output from (e.g., generated by) the position sensors 106. In an example, the control unit 112 determines (e.g., estimates or ascertains) the relative position of the movable segments and/or the working end of the robotic manipulators from analysis of the position data and detects any change in the position of the robotic manipulator 104, during the sanding operation. The control unit 112 determines (e.g., computationally via inverse kinematics) the spatial position of the sanding tool 102, for example, relative to the environment reference frame 214, from analysis of the position data and the known position of the sanding tool 102 relative to the robotic manipulator 104.

As illustrated in FIGS. 3 and 4, in an example, the position sensors 106 are operatively coupled between movable segments of the robotic manipulator 104, such as at a joint between an associated pair of movable segments. The position sensors 106 may be any one of various types of sensors capable to detecting a relative position of a movable part. In an example, the position sensors 106 are potentiometers that detect the position of robotic manipulator 104, or one or more of the moveable segments, based on a change in resistance of the potentiometers. In another example, the position sensors 106 are incremental encoders that determine a distance of travel from a home position of the robotic manipulator 104, or one or more of the moveable segments. In another example, the position sensors 106 are absolute encoders that determine the position of robotic manipulator 104, or one or more of the moveable segments.

As illustrated in FIGS. 1 and 2, in an example, the system 100 includes a three-dimensional (3D) scanner 110. The three-dimensional scanner 110 is communicatively coupled with the control unit 112. The three-dimensional scanner 110 is configured to detect the spatial position of the surface 202 of the structure 200. The control unit 112 is operable to generate the three-dimensional model 204 representing the structure 200, or the surface 202 of the structure 200, from a scanner output from (e.g., generated by) the three-dimensional scanner 110.

The three-dimensional scanner 110 enables the system 100 to determine the spatial position of the surface 202 and generate the three-dimensional model 204 of the surface 202 in real-time, such as when, or immediately prior to, moving the sanding tool 102 across the surface 202 along the sanding path 148. Real-time generation of the three-dimensional model 204 using the three-dimensional scanner 110 enables the system 100 to perform an automated sanding operation without requiring a theoretical three-dimensional model of the structure to be generated, prior to sanding, for each structure having a different geometry and/or a different surface contour. Real-time generation of the three-dimensional model 204 using the three-dimensional scanner 110 also enables the system 100 to sand different structures having various geometries and/or having variable surface contours without the need for respective, discrete computer control programming (e.g., numerical control) for each different geometry and/or surface contour. Real-time generation of the three-dimensional model 204 using the three-dimensional scanner 110 also provides a more accurate representation of the spatial position of the surface, since it is based on the actual surface being scanned by the three-dimensional scanner 110, rather than relying on an estimation of the spatial position of the surface based on the theoretical three-dimensional model of the structure and, therefore, minimizes or eliminates mismatches between the designed geometry of structure and the as-built geometry of the structure.

As illustrated in FIG. 2, in an example, the three-dimensional scanner 110 is coupled to the robotic manipulator 104, such as the gantry 166. In such an example, the three-dimensional scanner 110 is moved across the surface 202 when the robotic manipulator 104 moves across the surface 202. As such, movement of the robotic manipulator 104, such movement of the gantry 166, relative to the structure 200 corresponds to movement of the three-dimensional scanner 110 over the surface 202. The three-dimensional model 204 generated from the three-dimensional scanner 110 virtually represents the actual, or as built, geometry of the structure 200 including the as-built geometry and contour of the surface 202.

In an example implementation of the sanding operation using the as-built three-dimensional model 204, the three-dimensional scanner 110 is moved across the surface 202 when the sanding tool 102 moves across the surface 202 (i.e., the three-dimensional scanner 110 moves with the sanding tool 102). In such an example, the three-dimensional scanner 110 sequentially scans (i.e., in real-time) portions of the surface 202 along the sanding path 148 directly before the sanding tool 102 sands the respective portions of the surface 202. The control unit 112 then determines the spatial position of each sequential portion of the surface 202 (e.g., generates a three-dimensional model 204 representing the as-built geometry of each sequential portion of the surface 202). The control unit 112 then properly spatially positions the sanding tool 102 relative to each sequential portion of the surface 202 for sanding.

In another example implementation of the sanding operation using the as-built three-dimensional model 204, the three-dimensional scanner 110 is moved across the entire surface 202 before commencement, or initiation, of the sanding operation. The control unit 112 then determines the spatial position of an entirety of the surface 202 (e.g., generates the three-dimensional model 204 representing the as-built geometry of the entire surface 202). The control unit 112 then properly positions the sanding tool 102 relative to the surface 202 for sanding.

In an example, the three-dimensional scanner 110 emits light on the surface 202 and detects light reflected back from the surface 202. The three-dimensional scanner 110 is operable to generate position data representative of a number (e.g., a large number) of sample points on the surface 202 illuminated by the light. The position data indicates the spatial location (e.g., an XYZ coordinate) of each one of the sample points on the surface 202 relative to a reference frame, such as the environment reference frame 214.

Referring to FIGS. 1, 2, 4, and 7, in an example, the control unit 112 (FIGS. 1 and 2) generates the three-dimensional model 204 (FIG. 7), such as in the form of a polygon mesh, a surface model, or a point cloud (i.e., a set of data points in space), representing the surface 202 (FIG. 4), or the portion of the surface 202 illuminated by light, from the position data generated by the three-dimensional scanner 110 (FIGS. 1 and 2). The control unit 112 then ascertains the spatial position of the surface 202 relative to the environment reference frame 214 (FIGS. 4 and 7) from the three-dimensional model 204. In one or more example, the process described above is performed by operation of the control unit 112, for example, by execution of instructions in the form of program code and/or implementation of a software tool.

The three-dimensional scanner 110 may use any one of various three-dimensional scanning techniques, such as time-of-flight or triangulation, to determine the spatial location of the number of points on the surface 202 of the structure 200. Examples of the three-dimensional scanner 110 include, but are not limited to, a laser 3D scanner, a structured light 3D scanner, a modulated light 3D scanner, a light detecting and ranging (lidar) scanner, and the like.

Alternatively, in an example, the three-dimensional model 204 may be a theoretical model of the structure 200 representing the designed geometry of the structure 200. In such an example, the three-dimensional model 204 is pre-generated prior to initiation of the sanding operation and takes the form of a computer aided design (CAD) model of the structure 200. The three-dimensional model 204 virtually represents the designed, or theoretical, geometry of the structure 200 including the designed geometry and contour of the surface 202.

Figure 7:
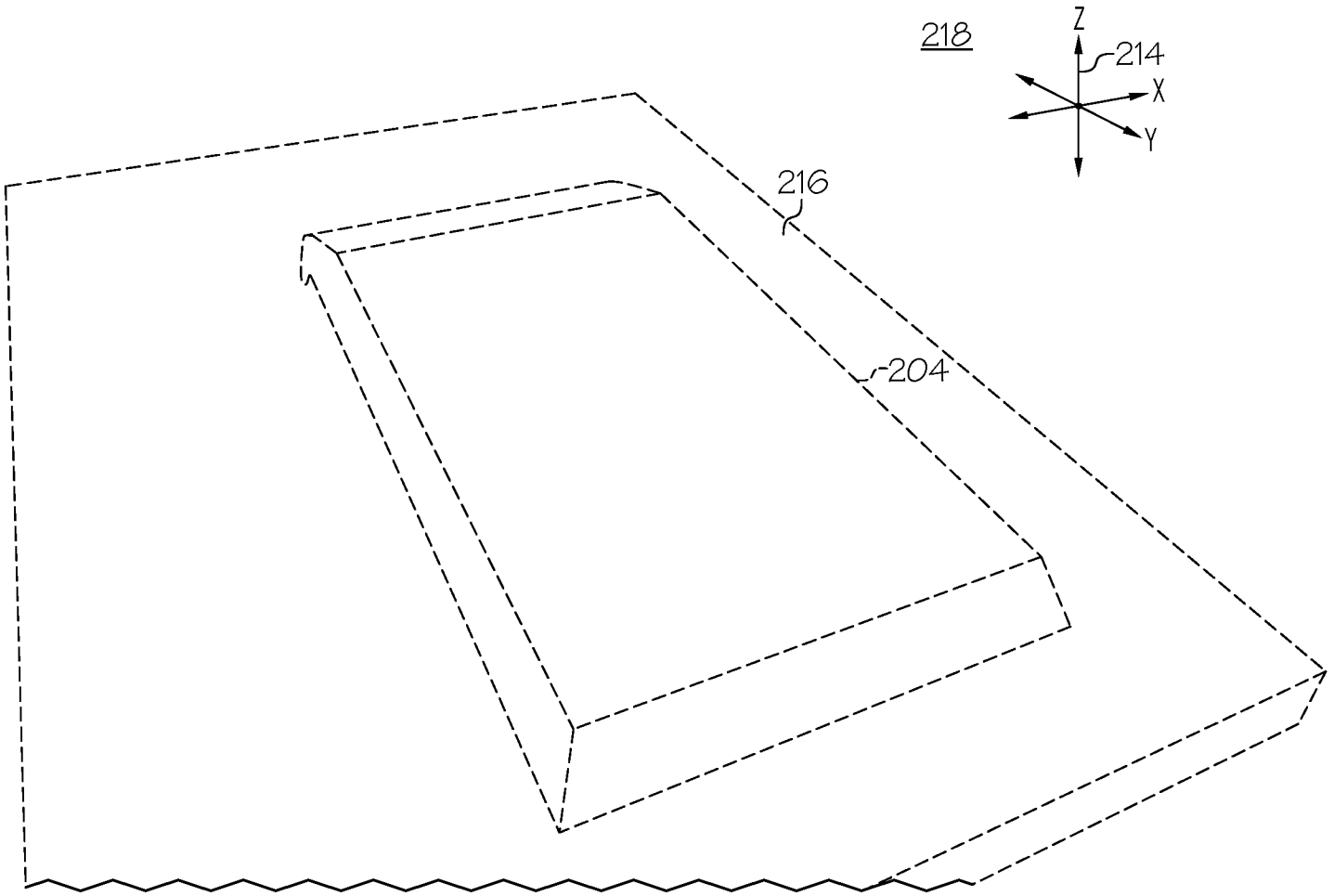
FIG. 7 is a schematic illustration of an example of a three-dimensional model representing the structure.

As illustrated in FIGS. 4 and 7, in an example implementation of the sanding operation using the deigned three-dimensional model 204, the structure 200 is positioned on the work surface 208 so that the spatial position of the surface 202 is fixed relative to the environment reference frame 214 (FIG. 4). In such an example, the structure 200 may be positioned at a predefined index location (not shown) relative to the work surface 208. The designed three-dimensional model 204 (FIG. 7) is virtually positioned relative to a virtual work surface 216 of a virtual operating environment 218 (FIG. 7) representative of, or corresponding to, the spatial position of the structure 200 on the work surface 208 of the operating environment 210. The control unit 112 then ascertains the spatial position of the surface 202 based on the designed three-dimensional model 204 relative to the environment reference frame 214.

Accordingly, the spatial position of the surface 202 may be determined from the as-built three-dimensional model 204 based on the scan of the surface 202 by the three-dimensional scanner 110 or from the designed three-dimensional model 204. Once the spatial position of the surface 202 is known, it may be desirable to control the spatial position of the sanding tool 102 so that the abrasive surface 120 is in approximately flush contact with the surface 202 and so that the sanding force 128 is approximately normal to the surface 202 when the sanding tool 102 is in the sanding position. Positioning the abrasive surface 120 is in approximately flush contact with the surface 202 and orienting the sanding force 128 approximately normal to the surface 202 when the sanding tool 102 is in the sanding position provides for improved quality of the overall sanding operation and improved consistency of surface characteristics achieved by the sanding operation. As such, in one or more examples, the system 100 includes means to position the abrasive surface 120 in contact with the surface 202 and orient the sanding force 128 approximately normal to the surface 202.

Figure 6:
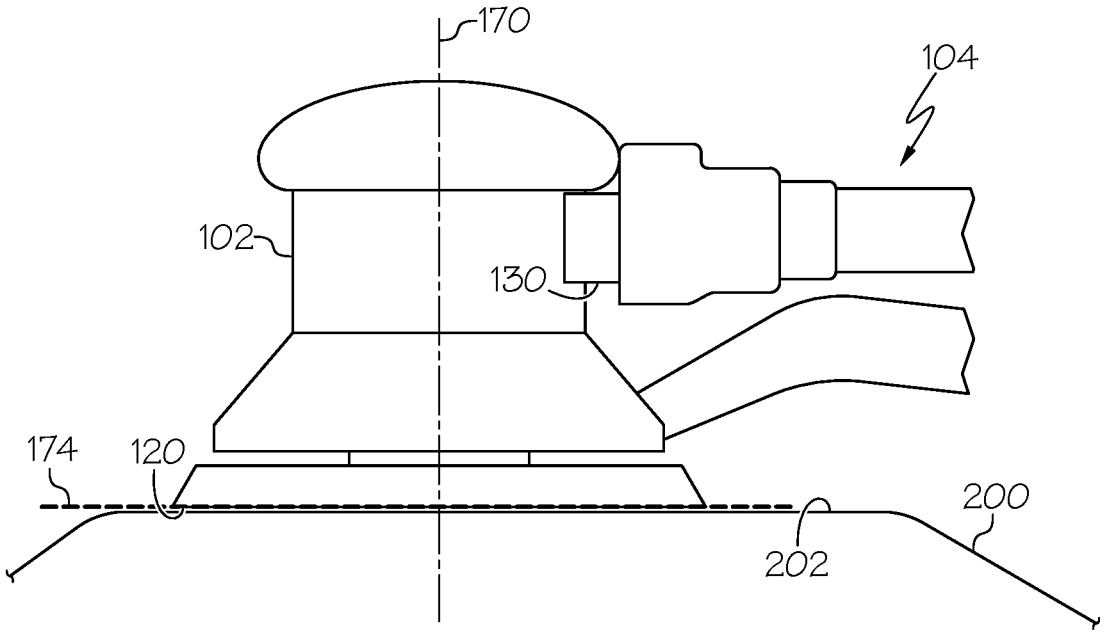
FIG. 6 is a schematic, elevation view of a portion of the system in a sanding position relative to the surface of the structure.
Figure 8:
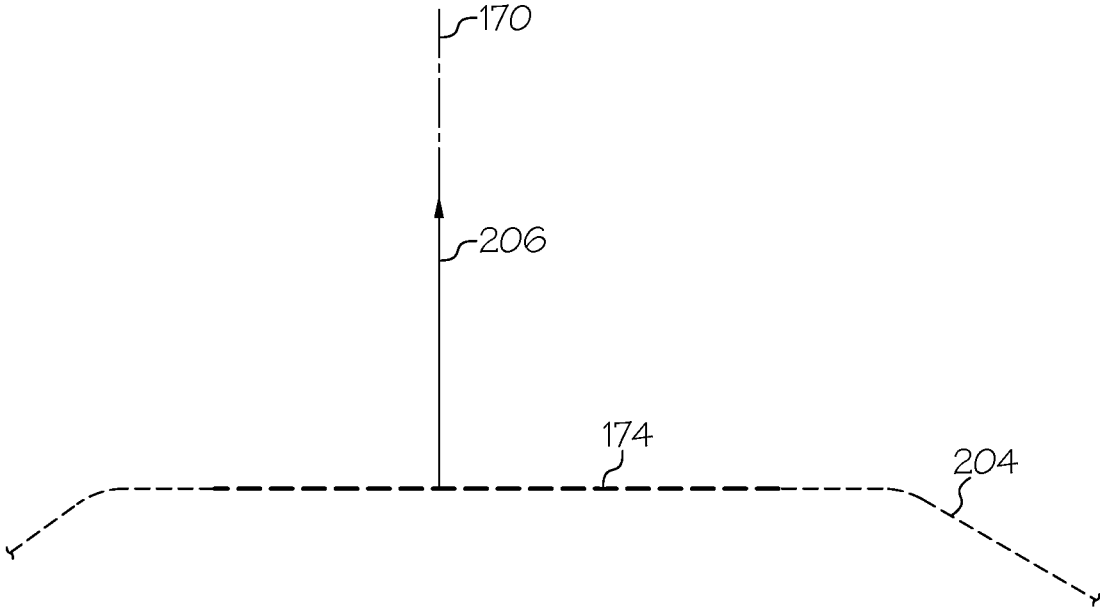
FIG. 8 is a schematic illustration of an example of a portion of the three-dimensional model.

Referring to FIGS. 6 and 8, in an example, the control unit 112 is operable to generate a normal vector 206 (FIG. 8) at a point on the three-dimensional model 204 (FIG. 8) of the surface 202 of the structure 200 (FIG. 6). In an example, the control unit 112 generates or estimates the normal vector 206 using computational analysis, such as a linear least squares method.

The control unit 112 is further operable to selectively control the angular spatial orientation 188 (FIG. 1) of the sanding tool 102 relative to the surface 202 so that the sanding axis 170 (FIG. 6) is aligned with the normal vector 206, such as by movement instructions provided to the robotic manipulator 104 (FIGS. 1 and 2). The control unit 112 is also operable to selectively control the spatial location 186 (FIG. 1) of the sanding tool 102 relative the surface 202 along the normal vector 206 so that a virtual plane 174 (FIG. 8), representing the abrasive surface 120, is coplanar with at least a portion of the three-dimensional model 204 of the surface 202, such as by movement instructions provided to the robotic manipulator 104.

Spatially orienting the sanding axis 170 (FIG. 6) and spatially locating the virtual plane 174 (FIGS. 6 and 8) spatially positions the sanding tool 102 and, more particularly, the abrasive surface 120 in the sanding position for commencement of the sanding operation, as illustrated in FIG. 6. Aligning the sanding axis 170 with the normal vector 206 (FIG. 8) spatially orients the sanding force 128 (FIG. 5) approximately normal to surface 202, as illustrated in FIG. 6. Locating the virtual plane 174, representing the abrasive surface 120, coplanar with at least a portion of the three-dimensional model 204, as illustrated in FIG. 8, locates the abrasive surface 120 in flush contact with the surface 202, as illustrated in FIG. 6.

For the purpose of the present disclosure, the terms "aligned," "aligning," and similar terms, such as in reference to the sanding axis 170 being aligned with the normal vector 206, means parallel to or coincident with. As an example, when the sanding tool 102 is in the sanding position, the sanding axis 170 is coincident with the normal vector 206. As another example, when the sanding tool 102 is in the sanding position, the sanding axis 170 is parallel to the normal vector 206. Generally, when the sanding axis 170 and, thus, the sanding force 128 are aligned with the normal vector 206, the normal vector 206 intersects and is perpendicular to the abrasive surface 120.

In circumstances where the sanding axis 170 is parallel to the normal vector 206, the sanding tool 102 is located relative to the surface 202 so that the sanding axis 170 has a linear offset distance from the normal vector 206 within a predetermined tolerance. For example, the control unit 112 is operable to select a closest normal vector 206 and control orientation of the sanding tool 102 so that the sanding axis 170 is parallel to that normal vector 206.

In an example implementation of positioning the sanding tool 102 in the sanding position, the control unit 112 determines the spatial position of at least a portion of the surface 202 from the spatial position ascertained from the three-dimensional model 204. The control unit 112 then estimates the normal vector 206 corresponding to, or associated with, the portion of the surface 202 of which the spatial position is ascertained. The control unit 112, via movement commands to the robotic manipulator 104, then selectively controls the position of the sanding tool 102 relative to the surface 202 so that the abrasive surface 120 of the sanding tool 102 is over a portion of the surface 202 that circumscribes the normal vector 206. The control unit 112, via movement commands to the robotic manipulator 104, then selectively controls the spatial orientation 188 of the sanding tool 102 so that the sanding axis 170 is aligned with the normal vector 206, which in turn orients the sanding force 128 (e.g., the direction of the vector of the sanding force 128) normal to the surface 202. The control unit 112, via movement commands to the robotic manipulator 104, then selectively controls the spatial location 186 of the sanding tool 102 relative to the surface 202 along the normal vector 206 so that the virtual plane 174 is coplanar with at least a portion of the three-dimensional model 204, which in turn locates the abrasive surface 120 in contact with the surface 202.

In certain circumstances, the three-dimensional model 204 of the structure 200 may be unavailable or the spatial position of the surface 202 may be otherwise unknown or inaccurate during one or more portions of the sanding operation. In other circumstances, the system 100 uses the determined spatial position of the surface 202 (e.g., from the three-dimensional model 204) to approximately position sanding tool 102 in the sanding position. In such circumstances, it may be desirable to accurately move the sanding tool 102 into the sanding position without complete reliance on a determination of or on the accuracy of the spatial position of the surface 202. As such, in one or more examples, the system 100 includes means to selectively control the spatial location 186 and the spatial orientation 188 of the sanding tool 102 relative to the surface 202 without full reliance on the spatial position of the surface 202 prior to commencement of the sanding operation.

Accordingly, rather than relying entirely on alignment of the sanding axis 170 with the normal vector 206 to orient the sanding force 128 approximately normal to the surface 202 when the sanding tool 102 is in the sanding position, in an alternative example, the control unit 112, via movement commands provided to the robotic manipulator 104, selectively controls the spatial orientation 188 (FIG. 1) of the sanding tool 102 relative to the surface 202 in response to detection of the torque applied to the sanding tool 102 by the surface 202 (i.e., based on feedback from the torque sensor 130). In such an example, when the abrasive surface 120 contacts the surface 202 of the structure 200, the spatial orientation 188 of the sanding tool 102 is automatically adjusted in response to the torque-sensor output from the torque sensor 130 until the measured (e.g., instantaneous) torque applied to the sanding tool 102 is below, or within an acceptable tolerance of, a predetermined torque threshold, which in turn orients the sanding force 128 approximately normal to the surface 202.

Similarly, rather than relying entirely on the virtual plane 174 being located in a coplanar relationship with the three-dimensional model 204 when the sanding tool 102 is in the sanding position, in an alternative example, the control unit 112, via movement commands provided to the robotic manipulator 104, selectively controls the spatial location 186 of the sanding tool 102 relative to the surface 202 in response to detection of the sanding force 128 applied to the surface 202 (e.g., based on feedback from the force sensor 108). In such an example, when the abrasive surface 120 contacts the surface 202 of the structure 200, the spatial location 186 of the sanding tool 102 is automatically adjusted, for example, in a direction approximately perpendicular to the surface 202, in response to the force-sensor output from the force sensor 108 until the actual (e.g., measured) sanding-force value is approximately equal to, or within an acceptable tolerance of, a predetermined sanding-force value threshold, which in turn locates the abrasive surface 120 in contact the surface 202.

During the sanding operation, it is also desirable to control the spatial position of the sanding tool 102 so that the abrasive surface 120 is maintained in approximately flush contact with the surface 202 and the sanding force 128 is maintained approximately normal to the surface 202 when the sanding tool 102 moves across the surface 202 along the sanding path 148. Maintaining the abrasive surface 120 in approximately flush contact with the surface 202 and maintain the sanding force 128 approximately normal to the surface 202 when the sanding tool 102 moves across the surface 202 may improve the quality of the overall sanding operation and/or improve consistency of surface characteristics achieved by the sanding operation. As such, in one or more examples, the system 100 includes means to maintain the position of the abrasive surface 120 in contact with the surface 202 and the orientation of the sanding force 128 approximately normal to the surface 202.

Referring to FIGS. 4 and 6-8, in an example, the control unit 112 is operable to generate a plurality of normal vectors 206 (only one of the normal vectors 206 is illustrated in FIG. 8) at a plurality of points on the three-dimensional model 204 of the surface 202 of the structure 200 along the sanding path 148 (FIGS. 4 and 7). The control unit 112 is operable to angularly orient the sanding tool 102 relative to the surface 202 so that the sanding axis 170 (FIG. 6) is aligned with each subsequent one of the normal vectors 206, when the sanding tool 102 moves across the surface 202 along the sanding path 148. The control unit 112 is also operable to linearly locate the sanding tool 102 relative the surface 202 along each one of the normal vectors 206 so that the virtual plane 174 (FIG. 8), representing the abrasive surface 120, is coplanar with at least a portion of the three-dimensional model 204 of the surface 202 at each subsequent location on the surface 202, when the sanding tool 102 moves across the surface 202 along the sanding path 148.

Spatially orienting the sanding axis 170 and spatially locating the virtual plane 174 maintains the sanding tool 102 and, more particularly, the abrasive surface 120 in the sanding position when the sanding tool 102 moves across the surface 202. Aligning the sanding axis 170 with each one of the normal vectors 206 maintains the sanding force 128 approximately normal to surface 202 at each subsequent sanding location along the sanding path 148 when the sanding tool 102 moves across the surface 202. Locating the virtual plane 174, representing the abrasive surface 120, coplanar with at least a portion of the three-dimensional model 204 maintains the abrasive surface 120 in contact with the surface 202 at each subsequent sanding location along the sanding path 148 when the sanding tool 102 moves across the surface 202.

In an example implementation of moving the sanding tool 102 across the surface 202 along the sanding path 148, the control unit 112 determines the spatial position of a plurality of portions of the surface 202 along the sanding path 148 from the ascertained spatial position of the three-dimensional model 204. The control unit 112 then estimates the normal vectors 206 corresponding to, or associated with, each one of the portions of the surface 202 of which the spatial position is ascertained. The control unit 112, via selective control and movement of the robotic manipulator 104, moves the sanding tool 102 relative to the surface 202 along the sanding path 148 so that the abrasive surface 120 of the sanding tool 102 moves over subsequent portions of the surface 202 that circumscribe each one of the normal vectors 206. When moving the sanding tool 102 along the sanding path 148, the control unit 112, via selective control and movement of the robotic manipulator 104, angularly orients the sanding tool 102 so that the sanding axis 170 is aligned with the each one of normal vectors 206, which in turn consistently maintains the sanding force 128 normal to the surface 202. When moving the sanding tool 102 along the sanding path 148, the control unit 112, via selective control and movement of the robotic manipulator 104, linearly moves the sanding tool 102 relative to the surface 202 along a corresponding one of the normal vectors 206 so that the virtual plane 174 is coplanar with at least a portion of the three-dimensional model 204, which in turn consistently maintains the abrasive surface 120 in contact with the surface 202.

Rather than relying entirely on alignment the sanding axis 170 with each one of the normal vectors 206 when moving the sanding tool 102 along the sanding path 148, in an alternative example, the control unit 112, via selective control and movement of the robotic manipulator 104, spatially orients the sanding tool 102 relative to the surface 202 in response to detection of the torque applied to the sanding tool 102 when the abrasive surface 120 moves across the surface 202 (i.e., based on feedback from the torque sensor 130). In such as example, when the sanding tool 102 moves across the surface 202, with the abrasive surface 120 in contact with the surface 202, the spatial orientation 188 of the sanding tool 102 is automatically adjusted in response to the torque-sensor output from the torque sensor 130 until the measured (e.g., instantaneous) torque applied to the sanding tool 102 is below, or within an acceptable tolerance of, the predetermined torque threshold, which in turn consistently maintains the sanding force 128 approximately normal to the surface 202.

Similarly, rather than relying entirely on the virtual plane 174 being maintained in a coplanar relationship with the three-dimensional model 204 when moving the sanding tool 102 along the sanding path 148, in an alternative example, the control unit 112, via selective control and movement of the robotic manipulator 104, spatially locates the sanding tool 102 relative to the surface 202 in response to detection of the sanding force 128 applied to the surface 202 (e.g., based on feedback from the force sensor 108). In such as example, when the sanding tool 102 moves across the surface 202, with the abrasive surface 120 in contact with the surface 202, the spatial location 186 of the sanding tool 102 is automatically adjusted, for example, in a direction approximately perpendicular to the surface 202, in response to the force-sensor output from the force sensor 108 until the actual (e.g., measured) sanding-force value is approximately equal to, or within an acceptable tolerance of, the predetermined sanding-force value threshold, which in turn consistently maintains the abrasive surface 120 in contact the surface 202.

Generally, during the sanding operation, selective control of one or more of the sanding parameters 126 so that the actual material removal rate 160 is approximately equal to the model material removal rate 124 is regularly or continually performed when, or while, positioning the sanding tool 102 in the sanding position and when, or while, moving the sanding tool 102 over the surface 202 along the sanding path 148 (FIG. 4).

During the sanding operation, it may be desirable to fully automate movement of the sanding tool 102 across the surface 202 along the sanding path 148. Full automation of the sanding operation may decrease processing time, improve consistency of the results of sanding, and reduce or eliminate operator injury. As such, in one or more examples, the system 100 includes means to automate movement of the sanding tool 102 across the surface 202 along the sanding path 148.

Figure 9:
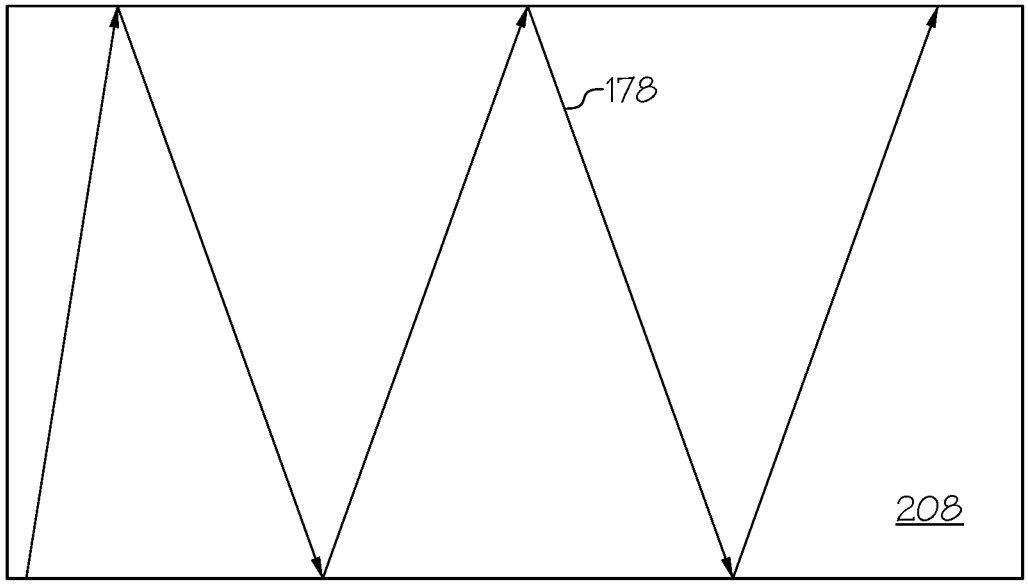
FIG. 9 is a schematic illustration of an example of a pre-programmed sanding path relative to a work surface.
Figure 10:
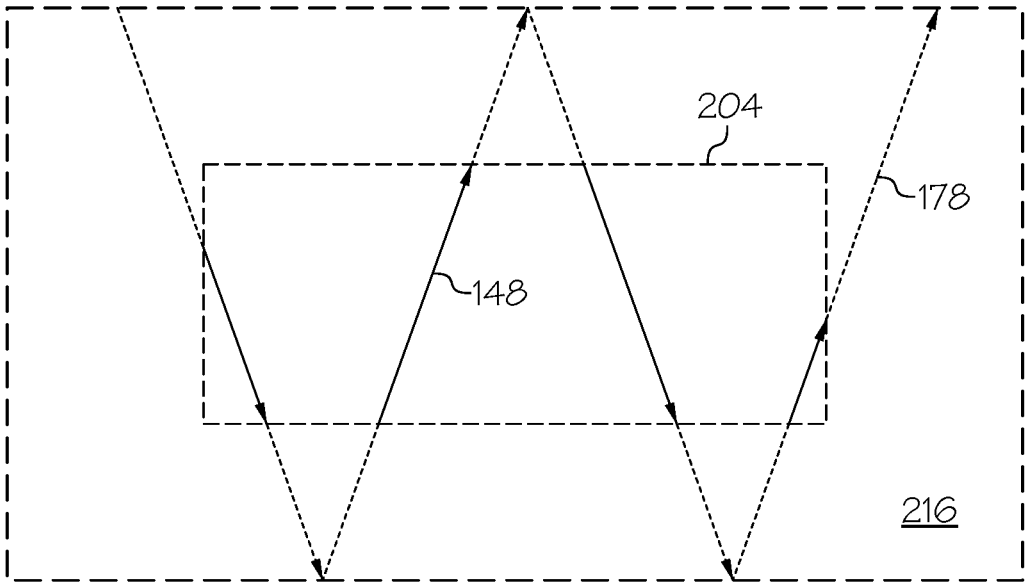
FIG. 10 is a schematic illustration of an example of a sanding path generated from the pre-programmed sanding path of FIG. 9.

Referring generally to FIGS. 1, 4, 7, 9, and 10, in an example, the control unit 112 (FIG. 1) is operable to automatically generate the sanding path 148 (FIGS. 4 and 10). Automatically generating the sanding path 148 fully automates movement of the sanding tool 102 across the surface 202 along the sanding path 148, as illustrated in FIG. 4.

As illustrated in FIG. 9, in an example, control unit 112 (FIG. 1) is configured to utilize a model sanding path 178. The model sanding path 178 is a fixed, pre-generated sanding path that extends across, or is provided over, the work surface 208 (FIGS. 4 and 9) on which the structure 200 (FIG. 4) is located during the sanding operation. In an example, the model sanding path 178 is generated (e.g., created or designed) so that, during the sanding operation, the abrasive surface 120 (FIG. 4) would engage an entirety of the work surface 208 (FIG. 9) when the sanding tool 102 is moved along the model sanding path 178.

In other words, the model sanding path 178 is a generic path, course, or route for the sanding tool 102 that is applicable to any structure having any one of various surface geometries. Use of the model sanding path 178 enables the system 100 to perform the sanding operation on various structures having different geometries without requiring an discrete sanding path to be generated for each different geometry. The particular path defined by the model sanding path 178 may vary depending, for example, on the type of sanding tool 102, the dimensions of the abrasive surface 120, and other factors.

Generally, the model sanding path 178 may follow any regular or irregular two-dimensional pattern. In an example, as illustrated in FIG. 9, the model sanding path 178 may be a raster path having a number of path segments that extend back-and-forth across the work surface 208 at an angled trajectory. In another example, the model sanding path 178 may be an indexed path having a number of forward path segments that extend across the work surface 208 and a number of return path segments that are indexed in a direction perpendicular to the forward path segments and that extend back across the work surface 208. In any of such examples, one or more of the path segments of the model sanding path 178 may be linear or may be non-linear or arcuate. It should be noted that the model sanding path 178 illustrated in FIG. 9 is simplified for clarity.

As best illustrated in FIGS. 4 and 9, once the model sanding path 178 (FIG. 9) has been provided that covers approximately the entirety of the work surface 208, the control unit 112 (FIG. 1) is operable to extract one or more selected portions of the model sanding path 178 (e.g., a portion of one of more of the path segments of the model sanding path 178) that intersect, or that are inclusively bound by, the surface 202 of the structure 200 (FIG. 4). The control unit 112 is operable to then designate such selected portions of the model sanding path 178 to be used as the sanding path 148 (depicted by dashed lines in FIG. 4) along which the sanding tool 102 will follow during the fully automated sanding operation. Designating the selected portions of the model sanding path 178 as the sanding path 148 enables the same model sanding path 178 to be used for different structures 200 having various sizes, shapes, geometries, configurations, and/or surface contours.

Referring generally to FIGS. 1, 2, 4, and 7, in an example, the control unit 112 (FIGS. 1 and 2) is operable to generate the virtual work surface 216 (FIG. 7). In such an example, the three-dimensional scanner 110 (FIGS. 1 and 2) scans both the structure 200 and the work surface 208 (FIG. 4) and generates scanner data (e.g., the scanner output) that represents both the structure 200 and the work surface 208.

The control unit 112 is operable to process the scanner data representing both the structure 200 and the work surface 208 and to extract the structure 200 from the work surface 208, as illustrated in FIG. 7. In an example, the control unit 112 performs an iterative analysis, such as random sample consensus (RANSAC), to identify data points that represent the edges (e.g., the outline) of the three-dimensional model 204 (FIG. 7), which correspond to the edges of the structure 200 (FIG. 4). For example, the RANSAC method is used to identify the largest plane in the point cloud, which is assumed to be the work surface 208 upon which the structure 200 sits. The points representing the largest plane in the point cloud (i.e., the work surface 208) are then removed, thus leaving the points in the point cloud representing the surface 202 of the structure 200. The control unit 112 may extract the data points bound within the outline of the three-dimensional model 204, which correspond to the surface 202 (FIG. 4) of the structure 200. The remaining outlying data points represent the virtual work surface 216, which corresponds to the work surface 208 (FIG. 4).

Accordingly, from the coordinate locations of the data points representing the outline of the three-dimensional model 204, the control unit 112 distinguishes the three-dimensional model 204 from the virtual work surface 216 and, thereby, distinguishes the surface 202 of the structure 200 from the work surface 208 (FIG. 4). The control unit 112 also ascertains the two-dimensional location of the structure 200 relative to the work surface 208. In other words, the two-dimensional geometry of the three-dimensional model 204 (FIG. 7) represents the surface 202 of the structure 200 (FIG. 4). The two-dimensional location of the three-dimensional model 204 relative to the virtual work surface 216 (FIG. 7) represents the two-dimensional location of the surface 202 relative to the work surface 208 (FIG. 4).

In one or more examples, the process described above is performed by operation of the control unit 112, for example, by execution of instructions in the form of program code and/or implementation of a software tool.

In an example, and as best illustrated in FIG. 10, once the two-dimensional geometry of the three-dimensional model 204 and the two-dimensional location of the three-dimensional model 204 relative to the virtual work surface 216 have been determined, the control unit 112 applies the model sanding path 178 (depicted by dashed lines in FIG. 10) to the virtual work surface 216. The portions of the model sanding path 178 that intersect the three-dimensional model 204, or are inclusively bound by the edges defining the three-dimensional model 204, are selected as the sanding path 148 (depicted as solid lines in FIG. 10). Thus, the model sanding path 178 is applicable to any structure having any two-dimensional geometry, while the sanding path 148 is tailored to the particular two-dimensional geometry of a given structure to be sanded. As illustrated in FIG. 4, during the sanding operation, the sanding tool 102 follows the course laid out by the sanding path 148, which is bound by the edges of the structure 200 that define the surface 202. As such, the sanding tool 102 will remain on the surface 202 of the structure 200 and will automatically cease movement at an edge of the surface 202.

In one or more examples, the process described above is performed by operation of the control unit 112, for example, by execution of instructions in the form of program code and/or implementation of a software tool.

While the examples of the process for automatically generating the sanding path 148 described above utilize the three-dimensional model 204 generated by the three-dimensional scanner 110 and representing the as-built geometry of the structure 200, in other examples, a substantially similar process may be performed when utilizing the three-dimensional model 204 that represents the designed, or theoretical, geometry of the structure 200.

During the sanding operation, it may be desirable to enable real-time selective control of at least a portion of the movement of the sanding tool 102 relative to the surface 202, such as by the human operator 212 (FIG. 2). Real-time selective control of the movement of the sanding tool 102 facilitates additional sanding to be performed at a particular location on the surface 202 as needed to achieve a desired surface characteristic. As such, in one or more examples, the system 100 includes means to enable human control of movement of the sanding tool 102.

Referring generally to FIGS. 1-4, in one or more examples, the system 100 enables human-machine collaboration during the sanding operation. In such examples, the sanding tool 102 is supported and moved by the robotic manipulator 104, thereby, eliminating direct physical interaction between the operator 212 (FIG. 2) and the sanding tool 102 and, as such, the risk of injury to the operator. In such examples, the operator 212 provides command instructions for at least a portion of the movement of the sanding tool 102 across the surface 202. In an example implementation of such a human-machine collaboration, a particular location on the surface 202 of the structure 200 to be sanded is selected by the operator 212. In another example implementation of such a human-machine collaboration, at least a portion of the sanding path 148, followed by the sanding tool 102 during the sanding operation, is defined by the operator 212.

As illustrated in FIG. 2, in an example, the system 100 includes a user interface 180. The user interface is communicatively coupled with the control unit 112. The user interface 180 is configured to receive directional input 182 (FIG. 1) from the operator 212. The control unit 112 is operable to incrementally generate the sanding path 148 based on the directional input 182 from the user interface 180. Accordingly, the user interface 180 enables the operator 212 to provide real-time command instructions to the robotic manipulator 104 to move the sanding tool 102 to one or more particular locations on the surface 202. The user interface 180 also enables the operator 212 to provide real-time command instructions to the robotic manipulator 104 to move the sanding tool 102 across the surface 202 following an improvised sanding path 148, such as a path, course, or route that is random or that is generated extemporaneously during the sanding operation.

The user interface 180 may be any one of various kinds of input devices or handheld controllers. In an example, the user interface 180 includes an analog stick, such as a joystick or a thumbstick, which is used for two-dimensional input. In such an example, the directional input 182 is based on the position of the analog stick in relation to a default center position. The user interface 180 registers movement of the analog stick (e.g., the directional input 182 from the operator 212) in any direction in two dimensions. The control unit 112 translates such movement into movement commands for the robotic manipulator 104, which in turn moves the sanding tool 102 in response to the directional input 182.

Referring generally to FIG. 1, the user interface 180 is operable to, or is configured to, control movement of the sanding tool 102 by providing input commands to the control unit 112, which are then passed on to the robotic manipulator 104.

In an example, the user interface 180 manually controls portions of the movement of the sanding tool 102 in two dimensions relative to the surface 202, such as in directions approximately parallel to the surface 202, while the control unit 112 automatically controls other portions of the movement of the sanding tool 102 in one dimension relative to the surface 202, such as in directions approximately perpendicular to the surface 202, and the angular orientation of the sanding tool 102 relative to the surface 202. As such, the user interface 180 enables the operator 212 to selectively position and move the sanding tool 102 relative to the surface 202, while the control unit 112 automatically positions the sanding tool 102 in the sanding position and automatically controls the sanding parameters 126 so that the actual material removal rate 160 is approximately equal to the model material removal rate 124.

As illustrated in FIGS. 1 and 2, in such an example, the user interface 180 controls the movement of the sanding tool 102 relative to the surface 202 of the structure 200, such as, in the X-direction and/or the Y-direction of the environment reference frame 214 (FIG. 2). The control unit 112 automatically controls the movement of the sanding tool 102 in the Z-direction the environment reference frame 214 or the angular orientation of the sanding tool 102 relative to the surface 202. The automatically controlled movement of the sanding tool 102 selectively controls the spatial location 186 (FIG. 1) of the sanding tool 102 to position the sanding tool 102 in the sanding position, which in turn places and maintains the abrasive surface 120 in contact with the surface 202 of the structure 200. The automatically controlled movement of the sanding tool 102 also selectively controls the sanding force 128, which in turn consistently maintains the actual material removal rate 160 being approximately equal to the model material removal rate 124. The automatically controlled portion of the movement of the sanding tool 102 also selectively controls the spatial orientation 188 (FIG. 1) of the sanding tool 102 relative to the surface 202, which in turn consistently maintains the sanding force 128 being approximately normal to the surface 202.

In another example, the user interface 180 manually controls portions of the movement of the sanding tool 102 in three dimensions relative to the surface 202, such as in directions approximately parallel and perpendicular to the surface 202, and/or the angular orientation of the sanding tool 102 relative to the surface 202. As such, the user interface 180 enables the operator 212 to selectively position and move the sanding tool 102 along localized contours of the surface 202, while the control unit 112 automatically controls the sanding parameters 126 so that the actual material removal rate 160 is approximately equal to the model material removal rate 124.

In an example, the user interface 180 is operable to selectively control the movement speed of the robotic manipulator 104 and, thus, the (e.g., variable) sanding-tool velocity 134 of the sanding tool 102. In such as example, the sanding-tool velocity 134 is selectively controlled depending on how far the analog stick is moved in a certain direction. In such an example, the control unit 112 automatically adjusts other sanding parameters 126 (e.g., the sanding force 128 and/or the (e.g., variable) abrasive-surface velocity 136) (FIG. 5) to account for the operator-controlled sanding-tool velocity 134 so that the actual material removal rate 160 is approximately equal to the model material removal rate 124 (FIG. 1).

Referring generally to FIGS. 1 and 2, in an example implementation of the operator 212 selectively controlling the sanding path 148 (FIG. 4), the directional input 182 (FIG. 1) from the user interface 180 is interpreted, or processed, by the control unit 112 and is used to determine a direction of movement of the sanding tool 102 and/or the sanding-tool velocity 134 (FIG. 5). The direction and/or velocity of the sanding tool 102 is used then by the control unit 112 to determine a subsequent (e.g., next) two-dimensional location of the sanding tool 102 relative to the surface 202. The control unit 112 then determines the spatial position of a portion of the surface 202 at the subsequent location and generates the normal vector 206 for the subsequent location. Based on the directional input 182, the control unit 112 instructs the robotic manipulator 104 to move the sanding tool 102 to the subsequent location. The control unit 112 automatically instructs the robotic manipulator 104 to spatially position the sanding tool 102 so that the sanding force 128 (FIG. 5) is normal to the surface 202 and has a magnitude based on the model material removal rate 124. In one or more examples, the system 100 (e.g., the control unit 112) includes a dedicated force controller operable to control and maintain the sanding force 128 needed to achieve the desired model material removal rate 124 (FIG. 1).

Figure 11:
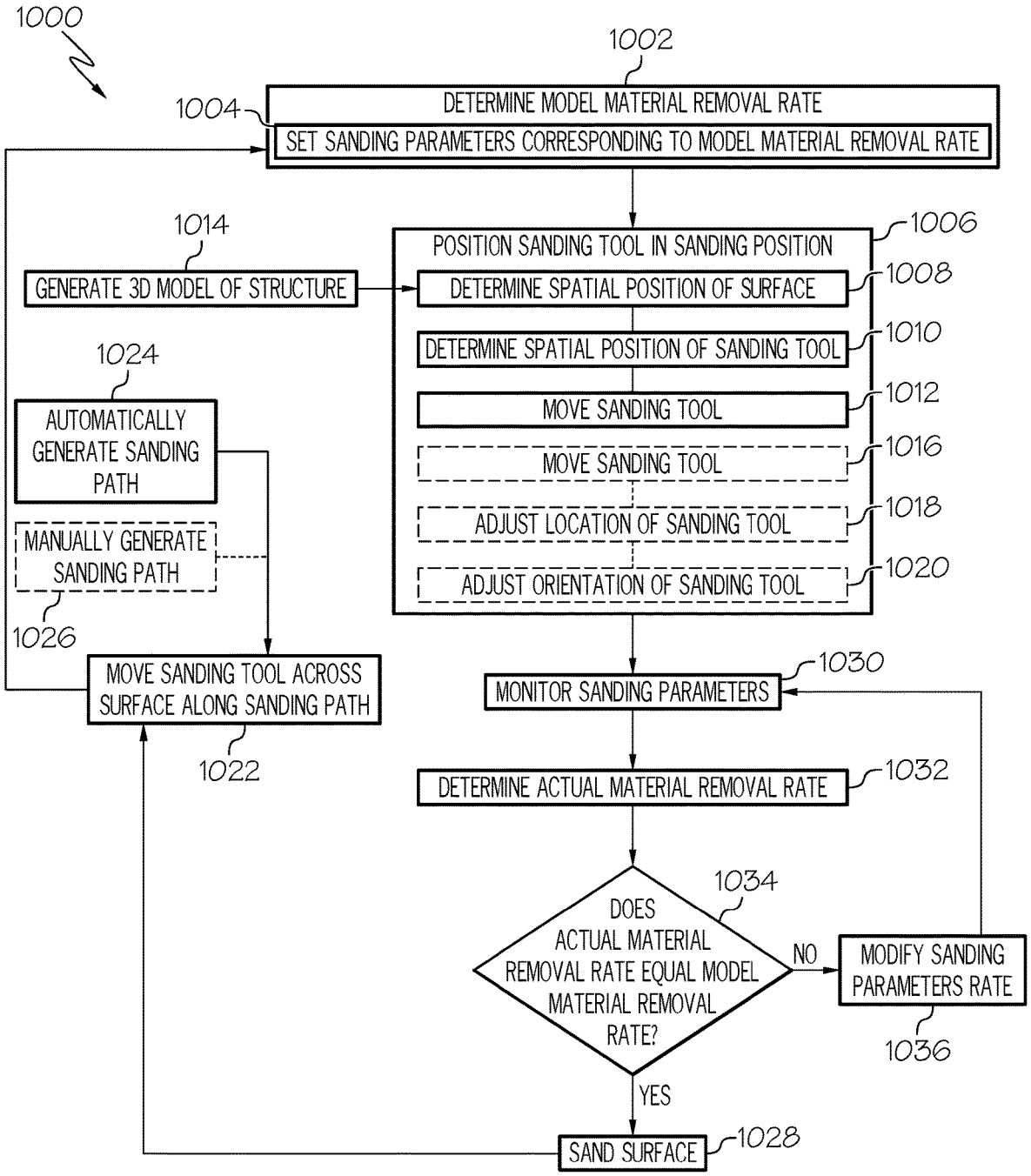
FIG. 11 is a flow diagram of an example of a method for sanding the surface of the structure.

Referring to FIG. 11, the present disclosure also provides examples of a method 1000 for sanding the surface 202 of the structure 200. Examples of the disclosed method 1000 provide operational implementations of the sanding operation utilizing the disclosed system 100 illustrated in FIGS. 1-10.

One or more examples of the method 1000 disclosed herein enable human-machine collaboration during the sanding operation. Human-machine collaboration may mitigate or eliminate many of the shortcomings or disadvantages of fully automated sanding operations and manual sanding operations.

One or more examples of the method 1000 disclosed herein also enable the sanding operation to be performed utilizing a consistent material removal rate. Utilization of a consistent material removal rate may improve the quality and accuracy of the sanding operation.

One or more examples of the method 1000 disclosed herein also enable real-time surface measurements of a structure to be sanded. Real-time surface measurements enable a sanding tool to be automatically positioned relative to the surface based on as-build geometry of the structure, which may improve the accuracy of the sanding operation.

One or more examples of the method disclosed herein also enable the sanding operation to be performed utilizing an automatically generated sanding path. An automatically generated sanding path enables full automation of the sanding operation.

Referring generally to FIGS. 1 and 5 and particularly to FIG. 11, in an example, the method 1000 includes a step (Block 1002) of determining, or defining, the model material removal rate 124 (FIG. 1) desired for the sanding operation to be performed, such as based on the material composition of the surface 202 to be sanded, the type of sanding tool 102 used, and other factors. The model material removal rate 124 is a function of the sanding parameters 126, including the variable sanding parameters 150, the constant sanding parameters 152, and the fixed sanding parameters 154 (FIG. 5). In one or more examples, the model material removal rate 124 is an experimentally determined rate of material removal or a computationally determined rate of material removal.

According to the method 1000, in an example, the step (Block 1002) of determining the model material removal rate 124 includes a step (Block 1004) of setting one or more of the sanding parameters 126 corresponding to the model material removal rate 124. The step (Block 1004) of setting one or more of the sanding parameters 126 may include a step of setting the parameters values (e.g., selecting initial parameter values) associated with one or more of the sanding parameters 126 (e.g., one or more of the variable sanding parameters 150), which correspond to the model material removal rate 124. The set parameters values represent the condition of the sanding parameters 126 (e.g., the variable sanding parameters 150) that needs to be maintained during the sanding operation to achieve the model material removal rate 124.

In an example, the step (Block 1004) of setting one or more of the sanding parameters 126 includes a step of identifying, or determining, the parameter values associated with the fixed sanding parameters 154, such as the material constant 146 (FIG. 5), corresponding to the model material removal rate 124.

In an example, the step (Block 1004) of setting one or more of the sanding parameters 126 also includes a step of identifying, or determining, the parameter values associated with the constant sanding parameters 152, such as the contact surface area 138, the sanding-tool velocity 134 (e.g., when the robotic manipulator 104 moves at a constant speed, and/or the abrasive-surface velocity 136 (e.g., when a constant speed sanding tool is used) (FIG. 5), corresponding to the model material removal rate 124.

In an example, the step (Block 1004) of setting one or more of the sanding parameters 126 also includes a step of identifying, or determining, the parameter values associated with the variable sanding parameters 150, such as the sanding force 128, the sanding-tool velocity 134 (e.g., when the robotic manipulator 104 moves at a variable speed, and/or the abrasive-surface velocity 136 (e.g., when a variable speed sanding tool is used) (FIG. 5), corresponding to the model material removal rate 124. In an example, the parameter values associated with the variable sanding parameters 150 are (e.g., initially) selected, or determined, to achieve the model material removal rate 124 given the parameter values set for the constant sanding parameters 152 and the fixed sanding parameters 154.

Referring generally to FIGS. 1-4 and 6 and particularly to FIG. 11, in an example, the method 1000 further includes a step (Block 1006) of positioning, or moving, the sanding tool 102 into the sanding position relative to the surface 202 of the structure 200, for example, at a particular sanding location on the surface 202. When the sanding tool 102 is positioned in, or moved to, the sanding position, the abrasive surface 120 of the sanding tool 102 is in contact with the surface 202 and the sanding axis 170 (FIG. 6) of the sanding tool 102, located perpendicular to the abrasive surface 120, is oriented approximately normal to the surface 202 so that the sanding force 128 (FIG. 5) is oriented approximately normal to the surface 202. In an example, the step (Block 1006) of positioning the sanding tool 102 to the sanding position is performed by the robotic manipulator 104 under control of the control unit 112.

Referring generally to FIGS. 1, 4, and 7 and particularly to FIG. 11, in an example, the step (Block 1006) of positioning the sanding tool 102 in the sanding position includes a step (Block 1008) of determining the spatial position of the surface 202 of the structure 200, a step (Block 1010) of determining the spatial position of the sanding tool 102 relative to the surface 202, and a step (1012) of moving the sanding tool 102 to the sanding position based on the determined spatial position of the sanding tool 102 and the spatial position of the surface 202.

In an example, the spatial position of the surface 202 of the structure 200 is determined based on the three-dimensional model 204 representing the surface 202 of the structure 200. In an example, the spatial position of the sanding tool 102 is determined based on the pose of the robotic manipulator 104.

Referring generally to FIGS. 1, 2, 4, and 7 and particularly to FIG. 11, in an example, the method 1000 also includes a step (Block 1014) of generating the three-dimensional model 204 of the structure 200, virtually representing the surface 202 of the structure 200. The spatial position of the structure 200 is determined based on the three-dimensional model 204. In an example, the three-dimensional model 204 is generated by and the spatial position of the surface 202 is detected using the three-dimensional scanner 110 (FIGS. 1 and 2). Use of the three-dimensional scanner 110 provides the three-dimensional model 204 that represents the as-build geometry of the structure 200. Use of the three-dimensional scanner 110 also facilitates determination of the spatial position of the structure 200 in real-time. Alternatively, the three-dimensional model 204 may be a pre-generated CAD model that represents the design geometry of the structure 200.

As illustrated in FIGS. 6 and 8, in an example, the step (1012) of moving the sanding tool 102 (FIG. 6) to the sanding position includes a step of angularly orienting the sanding tool 102 relative to the surface 202 (FIG. 6) so that the sanding axis 170 (FIG. 6) is aligned with the normal vector 206 (FIG. 8). In an example, the normal vector 206 is generated at a point on the three-dimensional model 204 representing the surface 202. In an example, the step (1012) of moving the sanding tool 102 (FIG. 6) to the sanding position also includes a step of linearly locating the sanding tool 102 relative the surface 202 along the normal vector 206 so that the virtual plane 174 (FIGS. 6 and 8) representing the abrasive surface 120 (FIG. 6) is coplanar with at least a portion of the three-dimensional model 204 of the surface 202. Spatially orienting the sanding axis 170 and spatially locating the virtual plane 174 spatially positions the sanding tool 102 and, more particularly, the abrasive surface 120 in the sanding position. Aligning the sanding axis 170 with the normal vector 206 spatially orients the sanding force 128 approximately normal to surface 202. Locating the virtual plane 174, representing the abrasive surface 120, in a coplanar relationship with at least a portion of the three-dimensional model 204 locates the abrasive surface 120 in contact with the surface 202.

According to the method 1000, in an alternative example, the step (Block 1006) of positioning the sanding tool 102 in the sanding position includes a step (Block 1016) of moving the sanding tool 102 to an initial position relative to the surface 202 of the structure 200. Generally, the initial position of the sanding tool 102 is a starting position, or estimated sanding position, that is close to the sanding position. In an example, the sanding tool 102 is moved into the initial position according to, or by performing, steps that are substantially similar to the steps (Blocks 1008, 1010, and 1012) described herein above. Accordingly, in some examples, the step (Block 1012) of moving the sanding tool 102 and the step (Block 1016) of moving the sanding tool 102 are essentially the same operation.

With the sanding tool 102 in the initial, or starting, position, the step (Block 1006) of positioning the sanding tool 102 in the sanding position also includes a step (Block 1018) of adjusting the linear location (e.g., the spatial location 186) (FIG. 1) of the sanding tool 102 relative to the surface 202 until a force applied to the surface 202 by the sanding tool 102 is detected. In an example, the force applied to the surface 202 by sanding tool 102 by is detected by the force sensor 108 (FIG. 1).

Detection of force applied to the surface 202 by the sanding tool 102 indicates that the abrasive surface 120 is in contact with the surface 202. Therefore, the sanding tool 102 is moved closer to the surface 202 until the force is detected. In a fully automated example implementation, the control unit 112 (FIGS. 1 and 2) automatically controls movement of the sanding tool 102 into contact with the surface 202. Alternatively, in a semi-automated example implementation, the sanding tool 102 is moved into contact with the surface 202 under directional control from the user interface 180 (FIGS. 1 and 2) (i.e., under manual control from the operator 212). In either of such examples, movement of the sanding tool 102 automatically ceases when the detected force reaches a predetermined force threshold indicating that the abrasive surface 120 is in full contact with the surface 202.

With the sanding tool 102 (e.g., the abrasive surface 120) in contact with the surface 202, the step (Block 1006) of positioning the sanding tool 102 in the sanding position also includes a step (Block 1020) of automatically adjusting the angular orientation (e.g., the spatial orientation 188) (FIG. 1) of the sanding tool 102 in response to detection of torque applied to the sanding tool 102 by the surface 202. In an example, torque applied to the sanding tool 102 by the surface 202 is detected by the torque sensor 130 (FIG. 1).

Detection of torque above a predetermined torque-threshold indicates that the sanding axis 170 (FIG. 6) is not oriented approximately perpendicular to the surface 202 and, thus, the sanding force 128 (FIG. 5) is not oriented approximately normal to the surface 202. Detection of no torque or torque below the predetermined torque-threshold indicates that the abrasive surface 120 is in full contact with the surface 202 and that the sanding axis 170 is oriented approximately perpendicular to the surface 202 and, thus, the sanding force 128 (FIG. 5) is oriented approximately normal to the surface 202. Therefore, when moving the sanding tool 102 to the sanding position, the angular orientation of the sanding tool 102 is automatically adjusted until the detected, or instantaneously measured, torque is below the predetermined torque-threshold, which corresponds to the sanding force 128 being approximately normal to the surface 202.

The alternative example described above may be used in circumstances where the spatial position of the surface 202 is unknown and/or in circumstances where the three-dimensional model 204 is unavailable. Additionally, the alternative example described above may be used in circumstances where the human operator 212 manually controls gross movement of the sanding tool 102 to the initial, starting position and the control unit 112 automatically controls fine movement of the sanding tool 102 to the sanding position.

Referring generally to FIG. 1 and particularly to FIG. 11, the method 1000 also includes a step (Block 1028) of sanding the surface 202 at approximately the model material removal rate 124 (FIG. 1). The method 1000 enables the actual material removal rate 160 (FIG. 1), which is achieved during the sanding operation, to be set and/or consistently maintained approximately equal to the model material removal rate 124 via automatically monitoring and regularly adjusting one or more of the sanding parameters 126 (FIG. 1), when the sanding tool 102 is in the sanding position. Achieving and consistently maintaining the model material removal rate 124 provides for a consistent material-removal depth and/or consistent surface characteristics to be achieved during a fully autonomous or a semi-autonomous sanding operation.

Referring generally to FIGS. 1-4 and particularly to FIG. 11, in an example, the method 1000 also includes a step (Block 1022) of moving the sanding tool 102 across the surface 202 along the sanding path 148 (FIG. 4). Moving the sanding tool 102 along the sanding path 148 positions the sanding tool 102 at sequential sanding locations on the surface 202, which are disposed along the sanding path 148. In an example, the step (Block 1022) of moving the sanding tool 102 across the surface 202 along the sanding path 148 is performed by the robotic manipulator 104 under control of the control unit 112, such as fully automated control or semi-automated control.

According to the method 1000, as illustrated in FIG. 11, when moving the sanding tool across the surface 202 of the structure 200 along the sanding path 148, the step (Block 1002) of determining the model material removal rate 124, the step (Block 1006) of positioning the sanding tool 102 in the sanding position, and the step of (Block 1028) of sanding the surface 202 at approximately the model material removal rate 124 may be iteratively repeated for each subsequent sanding location on the surface 202 along the sanding path 148 until the entire surface 202 has been sanded to a desired surface characteristic. At which point, the sanding operation is complete and the method 1000 ends.

Referring generally to FIGS. 1, 4, 9, and 10 and particularly to FIG. 11, in an example, the method 1000 includes a step (Block 1024) of automatically generating the sanding path 148 (FIG. 4). The step (Block 1024) of automatically generating the sanding path 148 includes a step of utilizing the model sanding path 178 (FIG. 9) that extends across the work surface 208 (FIG. 4) on which the structure 200 is located. The step (Block 1024) of automatically generating the sanding path 148 also includes a step of designating, or selecting, portions of the model sanding path 178 that intersect, or that are inclusively bound within, the surface 202 of the structure 200 as the sanding path 148. In such an example, the sanding operation implemented by the disclosed method 1000 is fully automated. Designating, or selecting, portions of the model sanding path 178 as the sanding path 148 enables the same model sanding path 178 to be used for different structures 200 having various sizes, shapes, geometries, configurations, and/or surface contours without a requirement for generating a different sanding paths for every different surface geometry.

Referring generally to FIGS. 1, 2, and 4 and particularly to FIG. 11, in an example, the method 1000 includes a step (Block 1026) of manually generating the sanding path 148. The step (Block 1026) of manually generating the sanding path 148 includes a step of receiving directional input 182 (FIG. 1) from the operator 212 (FIGS. 1 and 2) via the user interface 180 (FIGS. 1 and 2). The step (Block 1026) of manually generating the sanding path 148 also includes a step of incrementally generating the sanding path 148 based on the directional input 182 from the user interface 180. In such an example, the sanding operation implemented by the disclosed method 1000 is semi-automated and facilitates human-machine collaboration. Incrementally generating the sanding path 148 provides real-time command instructions to the robotic manipulator 104 to move the sanding tool 102 to a particular sanding location on the surface 202 and/or across the surface 202 following the sanding path 148 that is random or that is extemporaneously generated during the sanding operation.

When moving the sanding tool 102 along the sanding path 148 (FIG. 4), whether using the automatically generated sanding path or the manually generated sanding path, the sanding tool 102 is consistently maintained in the sanding position or is regularly repositioned in the sanding position at each sequential sanding location along the sanding path 148. Consistently maintaining or regularly repositioning the sanding tool 102 in the sanding position consistently maintains or regularly repositions the abrasive surface 120 of the sanding tool 102 in contact with the surface 202 and the sanding force 128 (FIG. 5) oriented approximately normal to the surface 202 at each subsequent sanding location when moving the sanding tool 102 across the surface 202 along the sanding path 148.

As illustrated in FIG. 11, according to the method 1000, the sanding tool 102 may be consistently maintained or regularly repositioned in the sanding position by performing steps that are substantially similar to the steps (Blocks 1008, 1010, and 1012) provided for the example of positioning the sanding tool in the sanding position, the steps (Block 1016, 1018, and 1020) provided for the alternative example of positioning the sanding tool in the sanding position, or a combination thereof.

In either of the above examples, the method 1000 may also include a step of detecting torque applied to the sanding tool 102 by the surface 202 of the structure 200 when moving the sanding tool 102 across the surface 202 along the sanding path 148. In an example, the torque applied to the sanding tool 102 by the surface 202 is detected by the torque sensor 130 (FIG. 1). The detected, or measured, torque is utilized to correct for errors in the normality of the sanding force 128 (FIG. 5) during movement of the sanding tool 102. In an example, the method 1000 also includes a step of automatically adjusting the angular orientation of the sanding tool 102 in response to the detected torque when moving the sanding tool 102 across the surface 202 along the sanding path 148. When the detected torque is above the predetermined torque-threshold, the angular orientation of the sanding tool 102 is automatically adjusted until the measured torque is below the predetermined torque-threshold, which corresponds to the sanding force 128 being consistently maintained approximately normal to the surface 202 when moving the sanding tool 102 across the surface 202 along the sanding path 148.

The method 1000 also provides for operational steps that enable the surface 202 to be consistently sanded at approximately the model material removal rate 124 (FIG. 1). Such steps, as described herein below, are generally performed when the sanding tool 102 is in the sanding position at any one of a plurality of sanding locations, for example, along the sanding path 148 (FIG. 4).

Referring generally to FIGS. 1 and 5 and particularly to FIG. 11, the method 1000 includes a step (Block 1030) of monitoring one or more of the sanding parameters 126. The one or more of the sanding parameters 126 are monitored when the sanding tool 102 is in the sanding position, for example, when the sanding tool 102 is stationary (e.g., at a particular sanding location) and when the sanding tool 102 is moving along the sanding path 148 (FIG. 4) (e.g., at each one of the subsequent sanding locations). The one or more of the sanding parameters 126 may be monitored continuously or regularly sampled.

The method 1000 also includes a step (Block 1032) of determining the actual material removal rate 160, based on the one or more of the sanding parameters 126 being monitored. The actual material removal rate 160 may be determined when the sanding tool 102 is in the sanding position, for example, when the sanding tool 102 is stationary and when the sanding tool 102 is moving along the sanding path 148 (FIG. 4). The actual material removal rate 160 may be determined continuously or at regular intervals.

The method 1000 also includes a step (Block 1034) of determining whether the actual material removal rate 160 (FIG. 1) is approximately equal to the model material removal rate 124 (FIG. 1). Such as determination may be made when the sanding tool 102 is in the sanding position, for example, when the sanding tool 102 is stationary and when the sanding tool 102 is moving along the sanding path 148 (FIG. 4). Such a determination may be performed continuously or at regular intervals.

When the actual material removal rate 160 (FIG. 1) is not approximately equal to, or is not within a predetermined allowable tolerance of, the model material removal rate 124 (FIG. 1), the method 1000 includes a step (Block 1036) of modifying one or more of the sanding parameters 126. The one or more of the sanding parameters 126 may be modified when the sanding tool 102 is in the sanding position, for example, when the sanding tool 102 is stationary and when the sanding tool 102 is moving along the sanding path 148 (FIG. 4). The one or more of the sanding parameters 126 may be modified continuously or at regular intervals.

As illustrated in FIG. 11, following modification of one or more of the sanding parameters 126, the operational steps (Blocks 1030, 1032, 1034, and 1036) are repeated iteratively until the actual material removal rate 160 (FIG. 1) is approximately equal to, or is within the predetermined allowable tolerance of, the model material removal rate 124 (FIG. 1). When the actual material removal rate 160 (FIG. 1) is approximately equal to, or is within the predetermined allowable tolerance of, the model material removal rate 124 (FIG. 1), the method 1000 continues to the step (Block 1028) of sanding the surface 202 (e.g., at the sanding location), with the actual material removal rate 160 being approximately equal to the model material removal rate 124. This process continues at each subsequent sanding location when moving the sanding tool 102 across the surface 202 along the sanding path 148, with the with the actual material removal rate 160 being consistent maintained approximately equal to the model material removal rate 124 during the sanding operation.

In some circumstances, the model material removal rate 124 desired for (or corresponding to) one or more sanding locations on the surface 202 or along one or more portions of the sanding path 148 may differ from the model material removal rate 124 desired for (or corresponding to) one or more other sanding locations on the surface 202 or one or more other portions along the sanding path 148. As such, and as illustrated in FIG. 11, when moving the sanding tool 102 across the surface 202 along the sanding path 148, the step (Block 1002) of determining the model material removal rate may be repeated, as needed, for different sanding locations and/or different portions along the sanding path 148.

Referring generally to FIGS. 1, 3, 5, and 11, according to the method 1000, in an example, one of the sanding parameters 126 being monitored is the sanding force 128 (FIG. 5), applied to the surface 202 of the structure 200 by the sanding tool 102. The sanding force 128 is utilized as a feedback measurement that enables the system 100 to computationally determine the actual material removal rate 160 (FIG. 1), as a function of the sanding force 128, and to maintain a consistent material removal rate by selectively controlling and adjusting the sanding force 128 until the actual material removal rate 160 is approximately equal to the model material removal rate 124 (FIG. 1).

In an example, the step (Block 1030) of monitoring one or more of the sanding parameters 126 (FIG. 2) includes a step of detecting the sanding force 128 (FIG. 5). The step (Block 1032) of determining the actual material removal rate 160 (FIG. 1) includes a step of determining the sanding force 128 from the force-sensor output of the force sensor 108 and computationally determining (e.g., estimating) the actual material removal rate 160 based on, or as a function of, the measured sanding force 128. The step (Block 1036) of modifying one or more of the sanding parameters 126 (FIG. 1) includes a step of adjusting the sanding force 128 until the actual material removal rate 160 (FIG. 1) is approximately equal to the model material removal rate 124 (FIG. 1).

In an example, the step of adjusting the sanding force 128 includes a step of linearly moving the sanding tool 102, in a direction perpendicular to the surface 202 of the structure 200. Moving the sanding tool 102 in a direction approximately perpendicular to the surface 202 selective controls the sanding force 128 by increasing or decreasing the sanding force 128 resulting from a change in location of the sanding tool 102 closer to or farther from the surface 202 so that the sanding force 128 is sufficient to achieve the model material removal rate 124. Selective control of the sanding force 128 also selective controls the sanding pressure 122. In an example, the step of linearly moving the sanding tool 102 is performed by the robotic manipulator 104 under control of the control unit 112.

Referring generally to FIGS. 1, 3, 5, and 11, according to the method 1000, in an example, one of the sanding parameters 126 being monitored is the (e.g., variable) sanding-tool velocity 134 (FIG. 5) of the sanding tool 102 relative to the structure 200. The sanding-tool velocity 134 is utilized as feedback that enables the system 100 to computationally determine the actual material removal rate 160, as a function of the sanding force 128, and maintain the consistent material removal rate by selectively controlling and adjusting the sanding-tool velocity 134 so that the actual material removal rate 160 is approximately equal to the model material removal rate 124.

In an example, the step (Block 1030) of monitoring one or more of the sanding parameters 126 includes a step of computationally determining the sanding-tool velocity 134 based on movement of the robotic manipulator 104. The step (Block 1032) of determining the actual material removal rate 160 includes a step of computationally determining (e.g., estimating) the actual material removal rate 160 based on, or as a function of, the ascertained sanding-tool velocity 134. The step (Block 1036) of modifying one or more of the sanding parameters 126 includes a step of adjusting the sanding-tool velocity 134 until the actual material removal rate 160 is equal to the model material removal rate 124.

Referring generally to FIGS. 1, 3, 5, and 11, according to the method 1000, in an example, one of the sanding parameters 126 being monitored is the (e.g., variable) abrasive-surface velocity 136 of the abrasive surface 120 relative to the sanding tool 102. The abrasive-surface velocity 136 is utilized as feedback that enables the system 100 to computationally determine the actual material removal rate 160, as a function of the abrasive-surface velocity 136, and maintain the consistent material removal rate by selectively controlling and adjusting the abrasive-surface velocity 136 so that the actual material removal rate 160 is approximately equal to the model material removal rate 124.

In an example, the step (Block 1030) of monitoring one or more of the sanding parameters 126 includes a step of detecting the abrasive-surface velocity 136. The step (Block 1032) of determining the actual material removal rate 160 includes a step of determining the abrasive-surface velocity 136 from the abrasive-surface velocity-sensor output from the abrasive-surface velocity sensor 164 and computationally determining (e.g., estimating) the actual material removal rate 160 based on, or as a function of, the measured abrasive-surface velocity 136. The step (Block 1036) of modifying one or more of the sanding parameters 126 includes a step of adjusting the abrasive-surface velocity 136 until the actual material removal rate 160 is equal to the model material removal rate 124.

Referring generally to FIGS. 1, 3, 5, and 11, according to the method 1000, in an example, one of the sanding parameters 126 being monitored is the sanding velocity 132 (FIG. 5) of the sanding tool 102. The sanding velocity 132 includes, or is a function of, the sanding-tool velocity 134 of the sanding tool 102 relative to the structure 200 and the abrasive-surface velocity 136 of the abrasive surface 120 relative to the sanding tool 102.

In an example, the step (Block 1030) of monitoring one or more of the sanding parameters 126 (FIG. 2) includes a step of detecting the sanding velocity 132. The step (Block 1032) of determining the actual material removal rate 160 (FIG. 1) includes a step of determining the sanding-tool velocity 134 and the abrasive-surface velocity 136. The step (Block 1036) of modifying one or more of the sanding parameters 126 includes a step of adjusting the sanding velocity 132 until the actual material removal rate 160 is equal to the model material removal rate 124. The step of adjusting the sanding velocity 132 includes a step of adjusting at least one of the sanding-tool velocity 134 and the abrasive-surface velocity 136 until the actual material removal rate 160 is equal to the model material removal rate 124.

According to the method 1000, in one or more examples, the one or more of the sanding parameters 126 being monitored is a combination of (e.g., two or more of) the (e.g., variable) sanding parameters 126. In such examples, the actual material removal rate 160 is determined based on the combination of the plurality of sanding parameters 126 being monitored. In such examples, one or more of the plurality of sanding parameters 126 being monitored is modified until the actual material removal rate 160 is approximately equal to the model material removal rate 124.

In one specific example, the sanding parameters 126 being monitored include the sanding force 128 and the (e.g., variable) abrasive-surface velocity 136. At least one of the sanding force 128 and the abrasive-surface velocity 136 is adjusted until the actual material removal rate 160 is approximately equal to the model material removal rate 124.

In another specific example, the sanding parameters 126 being monitored include the sanding force 128, the (e.g., variable) sanding-tool velocity 134, and the (e.g., variable) abrasive-surface velocity 136. At least one of the sanding force 128, the sanding-tool velocity, and the abrasive-surface velocity 136 is adjusted until the actual material removal rate 160 is approximately equal to the model material removal rate 124.

Referring to FIG. 1, the control unit 112 includes, or takes the form of, a computer or a computer system configured to operationally implement a number of controllers. The control unit 112 provides operating instructions to the various functional components of the system 100. When more than one computer is present, the computers may be in communications with each other through a communications medium, such as a network. In an example, the control unit 112 includes a processing unit 114 and memory 116 coupled to the processing unit 114, the memory 116 stores program instructions 118, the program instructions 118 are executable by the processing unit 114 to perform the operational steps disclosed herein.

In one or more examples, the control unit 112 is implemented using hardware, software, or a combination of hardware and software. When software is employed, a number of operations to be performed may be implemented in the form of program code or instructions stored on a computer readable storage medium (e.g., a non-transitory computer readable storage medium), such as the memory 116 (e.g., a hard disk, a CD-ROM, solid state memory, or the like), and configured to be executed by the processing unit 114. The processing unit 114 may include, or take the form of, a number of processors. In one or more examples, a corresponding processor implements or executes one of or a portion of the program instructions. In one or more examples, a corresponding processor implements or executes a number of the program instructions.

When hardware is employed, the hardware may include circuits that operate to perform the operations. In some examples, hardware may take the form of a circuit system, an integrated circuit, an application specific integrated circuit (ASIC), a programmable logic device, or some other suitable type of hardware configured to perform a number of operations. With a programmable logic device, the device is configured to perform a number of operations. The device may be reconfigured at a later time or may be permanently configured to perform a number of operations. Examples of programmable logic devices include, for example, a programmable logic array, a programmable array logic, a field programmable logic array, a field programmable gate array (FPGA), and other suitable hardware devices.

In one or more examples, the program instructions 118 take the form of one or more computer program products that include computer code stored on the memory 116 and executable by the processing unit 114 to perform the operational steps discussed herein. Generally, the control unit 112 provides an operating environment for execution of at least a portion of these operational steps. The control unit 112 may include any collection of computing devices that individually or jointly execute a set (or multiple sets) of instructions to implement any one or more of the operations discussed herein. Any type of computer system or other apparatus adapted for carrying out the operations described herein may be utilized. A typical combination of hardware and software may be a general-purpose computer system. The general-purpose computer system may include computer programs, such as the program instructions 118, that carry out the operational steps described herein.

The computer-usable storage medium may include computer-usable program code embodied thereon. For the purpose of this disclosure, the term "computer program product" refers to a device including features enabling the implementation of the operations described herein. The terms computer program, software application, computer software routine, and/or other variants of these terms may mean any expression, in any language, code, or notation, of a set of instructions intended to cause a computing system having information processing capability to perform a particular function either directly or after either or both of the following: a) conversion to another language, code, or notation; or b) reproduction in a different material form. Instructions may be referred to as program code, computer usable program code, or computer readable program code that may be read and executed by the processing unit 114. The program code, in the different examples, may be embodied on different physical or computer readable storage media, such as the memory 116.

In an example, the processing unit 114 is configured to execute program code or instructions stored on the memory 116 (e.g., internal memory, external memory, or a combination thereof). The processing unit 114 may take the form of any logic-processing unit, such as one or more of a central processing unit (CPU), a microprocessor, a digital signal processor (DSP), other suitable logic processors, or a combination thereof. The memory 116 may take the form of any data storage unit, such as one or more of read-only memory (ROM), random access memory (RAM), solid-state memory, a volatile or non-volatile storage device, other suitable data storage, or a combination thereof.

In one or more examples, the control unit 112 also includes number of input/output (I/O) devices. Examples of the I/O devices include, but are not limited to, one or more of a keypad, a keyboard, a touch-sensitive display screen, a liquid crystal display (LCD) screen, a microphone, a speaker, a communication port, or any combination thereof. Additionally, the user interface 180 is an example of one of the I/O devices.

Generally, the structure 200 referred to herein refers to any object that includes at least one surface that is to be sanded using by the disclosed system 100 and method 1000. For the purpose of this disclosure, the term "surface," such as in reference to the surface 202 of the structure 200, has its ordinary meaning as known to those skilled in the art and refers to any portion of an outer face of a structure.

In an example, the structure 200 is a manufactured article or assembly. In an example, the structure 200 is a manufactured component, such as a constituent part or element, of an article or assembly. In an example, the structure 200 is a vehicle, such as an aircraft. In an example, the structure 200 is a sub-assembly of a vehicle, such as a fuselage, a, wing, or an interior of an aircraft. In an example, the structure 200 is a component of a vehicle or a sub-assembly of the vehicle, such as a skin panel, a frame member, a stiffening member, or an interior panel of an aircraft.

The structure 200 may be made of any suitable material or combination of materials, such as composite materials, metallic materials, plastic materials, other suitable types of materials, or combinations thereof. In an example, the structure 200 is a composite structure formed by combining two or more functional composite materials, such as a matrix material and a reinforcement material. The matrix material may take the form of a thermoset resin (e.g., epoxy), a thermoplastic polymer (polyester, vinyl ester, nylon, etc.), or other types of matrix material. The reinforcement material may take the form of fibers (e.g., glass fibers, carbon fibers, aramid fibers, etc.) or other types of reinforcement materials. The fibers may be unidirectional or may take the form of a woven or nonwoven cloth, fabric, or tape.

Figure 12:
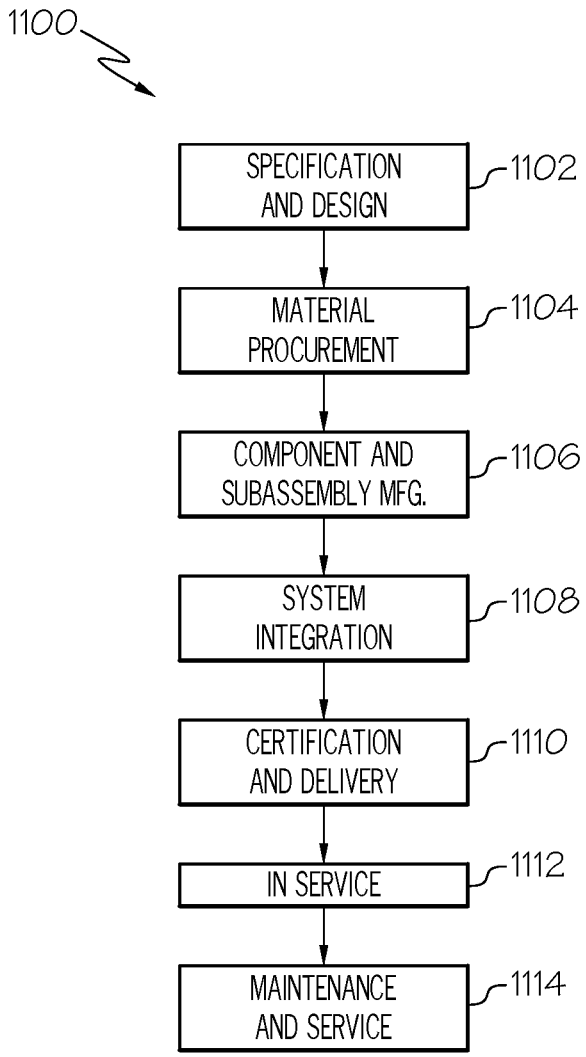
FIG. 12 is a flow diagram of an example aircraft production and service methodology.
Figure 13:
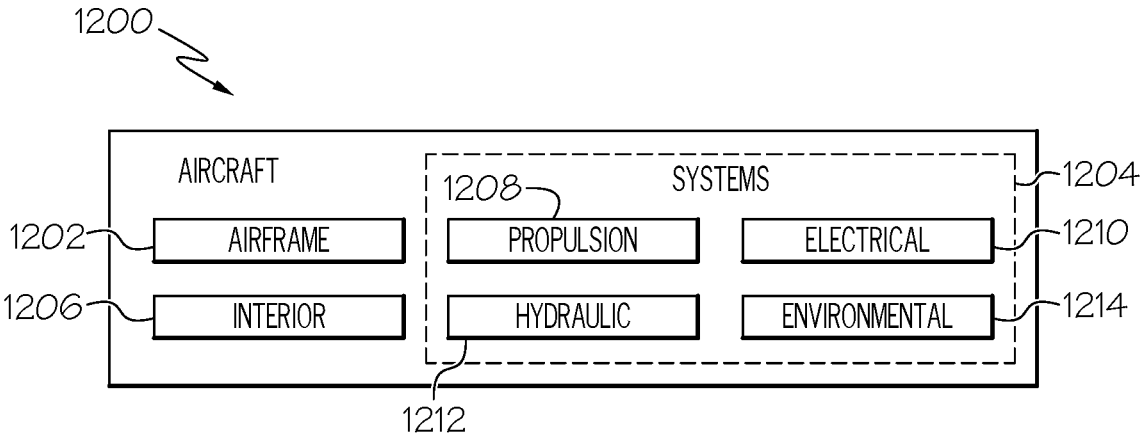
FIG. 13 is a schematic block diagram of an example of an aircraft.

Examples of the system and method disclosed herein may find use in a variety of potential applications, particularly in the transportation industry, including for example, aerospace applications. Referring now to FIGS. 12 and 13 examples of the system and method may be used in the context of an aircraft manufacturing and service method 1100, as shown in the flow diagram of FIG. 12 and an aircraft 1200, as shown in FIG. 13. Aircraft applications of the disclosed examples may include sanding surfaces of various components used in the manufacture of aircraft.

FIG. 13 is an illustrative example of an aircraft 1200. The aircraft 1200 includes an airframe 1202 and a plurality of high-level systems 1204 and an interior 1206. Examples of the high-level systems 1204 include one or more of a propulsion system 1208, an electrical system 1210, a hydraulic system 1212, and an environmental system 1214. In other examples, the aircraft 1200 may include any number of other types of systems.

The aircraft 1200 illustrated in FIG. 13 is an example of an aircraft having one or more structures with surfaces that may be sanded, such as with the disclosed system 100 and/or according to disclosed method 1000. In an example, the structure 200 is a structural member of the aircraft 1200 or is a portion of a structural assembly of the aircraft 1200. In an example, the structure 200 forms a part of the airframe 1202 of the aircraft 1200, such as a fuselage, a wing, a vertical stabilizer, a horizontal stabilizer, or another structure of the aircraft 1200, such as a skin panel, a stringer, a spar, a rib, a wing box, a stiffener, or other types of parts. In an example, the structure 200 forms the interior 1206 of the aircraft 1200, such as an interior panel.

As illustrated in FIG. 12, during pre-production, the illustrative method 1100 may include specification and design of aircraft 1200 (Block 1102) and material procurement (Block 1104). During production of the aircraft 1200, component and subassembly manufacturing (Block 1106) and system integration (Block 1108) of the aircraft 1200 may take place. Thereafter, the aircraft 1200 may go through certification and delivery (Block 1110) to be placed in service (Block 1112). The disclosed systems and methods may form a portion of component and subassembly manufacturing (Block 1106) and/or system integration (Block 1108). Routine maintenance and service (Block 1114) may include modification, reconfiguration, refurbishment, etc. of one or more systems of the aircraft 1200.

Each of the processes of the method 1100 illustrated in FIG. 12 may be performed or carried out by a system integrator, a third party, and/or an operator (e.g., a customer). For the purposes of this description, a system integrator may include, without limitation, any number of aircraft manufacturers and major-system subcontractors; a third party may include, without limitation, any number of vendors, subcontractors, and suppliers; and an operator may be an airline, leasing company, military entity, service organization, and so on.

Examples of the system 100 and method 1000 shown or described herein may be employed during any one or more of the stages of the manufacturing and service method 1100 shown in the flow diagram illustrated by FIG. 12. For example, components or subassemblies, such as those that include the structure 200, corresponding to component and subassembly manufacturing (Block 1106) may be fabricated or manufactured in a manner similar to components or subassemblies produced while the aircraft 1200 (FIG. 13) is in service (Block 1112). Also, one or more examples of the system and method disclosed herein may be utilized during production stages (Blocks 1108 and 1110). Similarly, one or more examples of the system and method disclosed herein may be utilized, for example and without limitation, while the aircraft 1200 is in service (Block 1112) and during maintenance and service stage (Block 1114).

Although an aerospace example is shown, the principles disclosed herein may be applied to other industries, such as the automotive industry, the space industry, the construction industry, and other design and manufacturing industries. Accordingly, in addition to aircraft, the principles disclosed herein may apply to other vehicle structures (e.g., land vehicles, marine vehicles, space vehicles, etc.) and stand-alone structures.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware that enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

Unless otherwise indicated, the terms "first", "second", etc. are used herein merely as labels, and are not intended to impose ordinal, positional, or hierarchical requirements on the items to which these terms refer. Moreover, reference to a "second" item does not require or preclude the existence of lower-numbered item (e.g., a "first" item) and/or a higher-numbered item (e.g., a "third" item).

For the purpose of this disclosure, the terms "coupled," "coupling," and similar terms refer to two or more elements that are joined, linked, fastened, connected, put in communication, or otherwise associated (e.g., mechanically, electrically, fluidly, optically, electromagnetically) with one another. In various examples, the elements may be associated directly or indirectly. As an example, element A may be directly associated with element B. As another example, element A may be indirectly associated with element B, for example, via another element C. It will be understood that not all associations among the various disclosed elements are necessarily represented. Accordingly, couplings other than those depicted in the figures may also exist.

As used herein, the phrase "at least one of", when used with a list of items, means different combinations of one or more of the listed items may be used and only one of each item in the list may be needed. For example, "at least one of item A, item B, and item C" may include, without limitation, item A or item A and item B. This example also may include item A, item B, and item C, or item B and item C. In other examples, "at least one of" may be, for example, without limitation, two of item A, one of item B, and ten of item C; four of item B and seven of item C; and other suitable combinations.

In FIGS. 1, 5, and 13, referred to above, the blocks may represent elements, components, and/or portions thereof and lines, if any, connecting various elements and/or components may represent mechanical, electrical, fluid, optical, electromagnetic and other couplings and/or combinations thereof. Couplings other than those depicted in the block diagrams may also exist. Dashed lines, if any, connecting blocks designating the various elements and/or components represent couplings similar in function and purpose to those represented by solid lines; however, couplings represented by the dashed lines may either be selectively provided or may relate to alternative examples. Likewise, elements and/or components, if any, represented with dashed lines, indicate alternative examples. One or more elements shown in solid and/or dashed lines may be omitted from a particular example without departing from the scope of the present disclosure. Environmental elements, if any, are represented with dotted lines. Virtual (imaginary) elements may also be shown for clarity. Those skilled in the art will appreciate that some of the features illustrated in FIGS. 1, 5, and 13, may be combined in various ways without the need to include other features described in FIGS. 1, 5, and 13, other drawing figures, and/or the accompanying disclosure, even though such combination or combinations are not explicitly illustrated herein. Similarly, additional features not limited to the examples presented, may be combined with some or all of the features shown and described herein.

In FIGS. 11 and 12, referred to above, the blocks may represent operations and/or portions thereof and lines connecting the various blocks do not imply any particular order or dependency of the operations or portions thereof. Blocks represented by dashed lines indicate alternative operations and/or portions thereof. Dashed lines, if any, connecting the various blocks represent alternative dependencies of the operations or portions thereof. It will be understood that not all dependencies among the various disclosed operations are necessarily represented. FIGS. 11 and 12 and the accompanying disclosure describing the operations of the disclosed methods set forth herein should not be interpreted as necessarily determining a sequence in which the operations are to be performed. Rather, although one illustrative order is indicated, it is to be understood that the sequence of the operations may be modified when appropriate. Accordingly, modifications, additions and/or omissions may be made to the operations illustrated and certain operations may be performed in a different order or simultaneously. Additionally, those skilled in the art will appreciate that not all operations described need be performed.

Although various examples of the disclosed systems and methods have been shown and described, modifications may occur to those skilled in the art upon reading the specification. The present application includes such modifications and is limited only by the scope of the claims.

What is claimed is:

1. A system for sanding a surface of a structure, the system comprising:

a sanding tool comprising an abrasive surface;

a robotic manipulator coupled to the sanding tool and configured to move the sanding tool relative to the structure; and a control unit operatively coupled with the sanding tool and the robotic manipulator, wherein the control unit is operable to:

move the sanding tool to a sanding position relative to the surface of the structure using the robotic manipulator, in which the abrasive surface is in contact with the surface and a sanding force, applied to the surface of the structure by the sanding tool, is approximately normal to the surface;

set one or more sanding parameters corresponding to a model material removal rate;

monitor one or more of the sanding parameters when the sanding tool is in the sanding position;

determine an actual material removal rate, based on one or more of the sanding parameters being monitored; and modify one or more of the sanding parameters until the actual material removal rate is approximately equal to the model material removal rate based on a comparison of the actual removal rate and the model material removal rate.

2. The system of claim 1, further comprising a number of sensors configured to detect a condition of one or more of the sanding parameters.

3. The system of claim 1, wherein:

one of the sanding parameters being monitored is the sanding force applied to the surface of the structure by the sanding tool; and the control unit is operable to adjust the sanding force until the actual material removal rate is approximately equal to the model material removal rate.

4. The system of claim 1, wherein:

one of the sanding parameters being monitored is an abrasive-surface velocity of the abrasive surface relative to the sanding tool; and the control unit is operable to adjust the abrasive-surface velocity until the actual material removal rate is approximately equal to the model material removal rate.

5. The system of claim 1, wherein:

one of the sanding parameters being monitored is a sanding-tool velocity of the sanding tool relative to the surface; and the control unit is operable to adjust the sanding-tool velocity until the actual material removal rate is approximately equal to the model material removal rate.

6. The system of claim 1, wherein the control unit is operable to:

monitor a torque applied to the sanding tool by the surface of the structure; and adjust an angular orientation of the sanding tool using the robotic manipulator so that the torque applied to the sanding tool is below a predetermined torque-threshold.

7. The system of claim 1, wherein the control unit is operable to:

determine a spatial position of the surface of the structure from a three-dimensional model representing at least a portion of the surface of the structure; and position the sanding tool in the sanding position based on the spatial position of the surface.

8. The system of claim 7, further comprising a three-dimensional scanner communicatively coupled with the control unit; and wherein:

the three-dimensional scanner is configured to detect the spatial position of the surface of the structure; and the control unit is operable to generate the three-dimensional model, representing at least a portion of the surface, from a scanner output generated by the three-dimensional scanner.

9. The system of claim 7, wherein:

the sanding tool further comprises a sanding axis, perpendicular to the abrasive surface; and the control unit is operable to:

generate a normal vector at a point on the three-dimensional model of the surface of the structure;

angularly orient the sanding tool relative to the surface using the robotic manipulator so that the sanding axis is aligned with the normal vector; and linearly locate the sanding tool relative the surface along the normal vector using the robotic manipulator so that a virtual plane representing the abrasive surface is coplanar with the three-dimensional model of the surface.

10. The system of claim 1, wherein the control unit is operable to:

move the sanding tool across the surface along a sanding path using the robotic manipulator;

regularly monitor one or more of the sanding parameters when the sanding tool moves across the surface along the sanding path;

regularly determine the actual material removal rate, based on one or more of the sanding parameters being monitored, when the sanding tool moves across the surface along the sanding path; and regularly modify one or more of the sanding parameters so that the actual material removal rate is consistently maintained approximately equal to the model material removal rate when the sanding tool moves across the surface along the sanding path.

11. The system of claim 10, wherein the control unit is operable to:

consistently maintain the sanding tool in the sanding position using the robotic manipulator when the sanding tool moves across the surface along the sanding path; or regularly reposition the sanding tool in the sanding position using the robotic manipulator when the sanding tool moves across the surface along the sanding path.

12. The system of claim 10, wherein the control unit is operable to:

utilize a model sanding path that extends across a work surface on which the structure is located; and automatically designate portions of the model sanding path that intersect the surface of the structure as the sanding path.

13. The system of claim 10, further comprising a user interface communicatively coupled with the control unit; and wherein:

the user interface is configured to receive directional input from an operator; and the control unit is operable to incrementally generate the sanding path based on the directional input from the user interface.

14. A method for sanding a surface of a structure, the method comprising steps of:

moving a sanding tool to a sanding position relative to the surface of the structure in which an abrasive surface of the sanding tool is in contact with the surface and a sanding force, applied to the surface of the structure by the sanding tool, is approximately normal to the surface;

setting one or more sanding parameters corresponding to a model material removal rate;

monitoring one or more of the sanding parameters when the sanding tool is in the sanding position;

determining an actual material removal rate, based on one or more of the sanding parameters being monitored; and modifying one or more of the sanding parameters until that the actual material removal rate is approximately equal to the model material removal rate.

15. The method of claim 14, wherein:

the one or more sanding parameters being monitored comprises at least one of the sanding force applied to the surface of the structure by the sanding tool and an abrasive-surface velocity of the abrasive surface relative to the sanding tool; and the step of modifying one or more of the sanding parameters comprises adjusting at least one of the sanding force and the abrasive-surface velocity until the actual material removal rate is approximately equal to the model material removal rate.

16. The method of claim 15, further comprising steps of:

moving the sanding tool across the surface along a sanding path;

regularly monitoring one or more of the sanding parameters, when moving the sanding tool across the surface along the sanding path;

regularly determining the actual material removal rate, based on one or more of the sanding parameters being monitored, when moving the sanding tool across the surface along the sanding path; and regularly modifying one or more of the sanding parameters so that the actual material removal rate is consistently maintained approximately equal to the model material removal rate when moving the sanding tool across the surface along the sanding path.

17. The method of claim 16, wherein:

the one or more of the sanding parameters being monitored further comprises a sanding-tool velocity of the sanding tool relative to the structure; and the step of regularly modifying one or more of the sanding parameters comprises adjusting the sanding-tool velocity until the actual material removal rate is approximately equal to the model material removal rate when moving the sanding tool across the surface along the sanding path.

18. The method of claim 16, further comprising:

utilizing a model sanding path that extends across a work surface on which the structure is located; and designating portions of the model sanding path that intersect the surface of the structure as the sanding path.

19. The method of claim 16, further comprising:

receiving directional input from an operator by a user interface; and incrementally generating the sanding path based on the directional input from the user interface.

20. The method of claim 14, further comprising:

determining a spatial position of the surface of the structure from a three-dimensional model representing at least a portion of the surface of the structure; and positioning the sanding tool in the sanding position based on the spatial position of the surface.

* * * * *